US009725946B1

(12) United States Patent
Vassilev et al.

(10) Patent No.: US 9,725,946 B1
(45) Date of Patent: Aug. 8, 2017

(54) CLADDING SYSTEM FOR GLAZED DOORS AND WINDOWS

(71) Applicant: Gregory A Header, Pine Grove, PA (US)

(72) Inventors: Anton Vassilev, Lebanon, PA (US); Gregory A Header, Richland, PA (US)

(73) Assignee: Gregory A Header, Pine Grove, PA (US)

( * ) Notice: Subject to any disclaimer, the term of this patent is extended or adjusted under 35 U.S.C. 154(b) by 0 days.

(21) Appl. No.: 15/260,155

(22) Filed: Sep. 8, 2016

(51) Int. Cl.
*E06B 3/30* (2006.01)
*E06B 1/34* (2006.01)

(52) U.S. Cl.
CPC ..... *E06B 3/302* (2013.01); *E06B 1/34* (2013.01)

(58) Field of Classification Search
CPC ..... E06B 3/302; E06B 1/34; E06B 1/342
See application file for complete search history.

(56) References Cited

U.S. PATENT DOCUMENTS 1,041,645 A 10/1912 MacDowney
3,130,455 A * 4/1964 Borlenghi ..... E06B 1/32 49/504
3,662,494 A * 5/1972 Sitterly ..... E06B 1/342 49/504
3,667,179 A 6/1972 Eisenberg
3,803,779 A * 4/1974 Kuyper ..... E06B 3/5454 52/476
3,815,285 A 6/1974 Kuyper
3,984,954 A * 10/1976 Takeda ..... E06B 1/342 160/90
4,122,633 A 10/1978 Holdiman
4,139,973 A * 2/1979 Fujita ..... E06B 3/5409 52/204.591
4,207,707 A 6/1980 Holdiman et al.
(Continued)

FOREIGN PATENT DOCUMENTS

CH 705792 A2 * 5/2013 ..... E06B 1/342
CN 204152386 U 2/2015
(Continued)

OTHER PUBLICATIONS

DW Outward Opening Alu-Clad Window Technical Details, Apr. 10, 2012, Nordica UK Ltd., United Kingdom.
(Continued)

*Primary Examiner* — Rodney Mintz
(74) *Attorney, Agent, or Firm* — Stone Creek Services LLC; Alan M Flum

(57) ABSTRACT

A low-profile cladding system that can be readily applied to doors, windows, fixed light openings, or curtain walls where thermal performance is important. The cladding system utilizes a cladding member in combination with an L-shaped bracket to attach and secure the cladding member to a frame or sash. The cladding member is held to the frame or sash by tension or pressure between opposite ends of the cladding member. This tension is created by the L-shaped bracket in combination with the cladding ends as the L-shaped bracket engages one cladding member end and is pivoted into an indentation, or recess, in the frame or sash. The other cladding member end engages a groove along the side of the frame or sash opposite to the indentation.

19 Claims, 17 Drawing Sheets

(56) References Cited

U.S. PATENT DOCUMENTS

| | | | | | |
|---|---|---|---|---|---|
| 4,307,543 | A * | 12/1981 | Schulthess | E06B 5/164 | 49/501 |
| 4,341,048 | A | 7/1982 | Minter | | |
| 4,479,331 | A * | 10/1984 | Bertolami | E06B 3/302 | 49/404 |
| 5,072,547 | A * | 12/1991 | DiFazio | E06B 1/34 | 49/504 |
| 5,182,880 | A | 2/1993 | Berge, Jr. et al. | | |
| 5,339,583 | A | 8/1994 | Hrdlicka et al. | | |
| 5,584,150 | A * | 12/1996 | Newman | E04C 3/02 | 52/204.2 |
| 5,669,192 | A * | 9/1997 | Opdyke | E06B 1/34 | 52/211 |
| 5,836,118 | A * | 11/1998 | Thornton | E06B 1/34 | 49/504 |
| 5,836,119 | A * | 11/1998 | Emmanuel | E06B 3/26345 | 52/204.54 |
| 5,916,077 | A * | 6/1999 | Tang | E06B 1/325 | 49/501 |
| 6,125,605 | A * | 10/2000 | Young | E06B 1/34 | 52/211 |
| 6,167,661 | B1 | 1/2001 | Christensen | | |
| 6,223,484 | B1 * | 5/2001 | Minter | E06B 1/6015 | 49/504 |
| 6,604,334 | B2 | 8/2003 | Rochman | | |
| 6,631,595 | B1 * | 10/2003 | Minter | E06B 1/62 | 49/504 |
| 6,740,187 | B2 * | 5/2004 | Schweikart | E06B 3/30 | 156/250 |
| 7,204,059 | B2 | 4/2007 | Schiffmann et al. | | |
| 8,074,410 | B1 * | 12/2011 | Ryba | E06B 1/702 | 52/204.1 |
| 8,511,012 | B2 * | 8/2013 | Scalzi | E04F 13/0864 | 52/204.53 |
| 8,776,460 | B2 * | 7/2014 | Carlson | E06B 3/4618 | 52/204.55 |
| 8,959,851 | B1 * | 2/2015 | Cardinal | E06B 3/26341 | 49/489.1 |
| 9,598,892 | B2 * | 3/2017 | Header | E06B 1/34 | |
| 2001/0034985 | A1 * | 11/2001 | Schweikart | E06B 3/30 | 52/204.5 |
| 2002/0046532 | A1 * | 4/2002 | Rochman | E06B 1/34 | 52/656.4 |
| 2004/0006938 | A1 * | 1/2004 | Schiffmann | E04G 21/30 | 52/211 |
| 2004/0206025 | A1 * | 10/2004 | Panto | E06B 3/10 | 52/211 |
| 2008/0196342 | A1 * | 8/2008 | Franklin | E06B 3/2675 | 52/309.1 |
| 2010/0251642 | A1 * | 10/2010 | Erickson | E06B 1/34 | 52/204.1 |
| 2015/0068141 | A1 * | 3/2015 | Cardinal | E06B 3/56 | 52/209 |
| 2015/0361712 | A1 * | 12/2015 | Eisenbarth | E06B 1/08 | 52/204.5 |
| 2016/0076298 | A1 * | 3/2016 | Header | E06B 3/303 | 52/204.5 |

FOREIGN PATENT DOCUMENTS

| | | | | |
|---|---|---|---|---|
| CN | 204492489 | U | 7/2015 | |
| DE | 2553985 | A1 * | 6/1977 | E06B 1/34 |
| DE | 102016001102 | A1 * | 11/2016 | E06B 3/302 |
| EP | 1258592 | B1 | 11/2004 | |

OTHER PUBLICATIONS

VW12 Outward Opening Alu-Clad Window Technical Details, Oct. 12, 2010, Nordica UK Ltd., UK.

Albo Al-Trend Standard 3+ Hranata Profilace, AL 5000S, Mar. 2010, Alois Bouchai Company, Czech Republic.

Albo Al-Trend Standard 3+ Kulata Profilace, AL 5000S, Mar. 2010, Alois Bouchai Company, Czech Republic.

Bronze and Aluminum Clad Windows and Doors, Mar. 17, 2006, SwissShade + Security Inc., Tucson, AZ, United States.

Zola Windows Perspective Section Illustration downloaded from the Internet at http://www.zolawindows.com/wp-content/uploads/2015/11/classic-upvc-clad.png on Jul. 22, 2016.

Nood Products Catalog, Feb. 23, 2013, European Architectural Supply, Sudbury, MA, United States.

Wood-Aluminum Systems Gutman CORA, Apr. 25, 2014, Gutmann AG, Germany.

Wood-Aluminum Systems Gutman MIRA contour, Apr. 25, 2014, Gutmann AG, Germany.

Wood-Aluminum Systems Gutman MIRA contour integral, Apr. 25, 2014, Gutmann AG, Germany.

Wood-Aluminum Systems Gutman Nordwin, Apr. 25, 2014, Gutmann AG, Germany.

Internorm Windows Highlighs of Architecture 2014/15, Mar. 14, 2014, Internorm Windows UK Ltd, United Kingdom.

HM-Metal Clad Wood Windows and Doors, Oct. 24, 2014, Menck Windows, Chicopee, MA, United States.

Sun Clad Exterior—Comparison of Exterior Sash and Frame Materials Downloaded from the Internet at: http://sunwindows.com/Why%20Sun/CladComparison.html on Jul. 21, 2016.

Make Window: an idea log of windows, window details, and ideas that make us rethink the way we make windows, blog entries from Aug. 27, 2012 to Oct. 20, 2012, p. 4 of 15 of blog, accessed on the Internet at http://makewindow.tumblr.com/page/4 on Aug. 18, 2016.

Make Window: an idea log of windows, window details, and ideas that make us rethink the way we make windows, blog entries from Jul. 15, 2013 to Mar. 12, 2014, p. 2 of 15 of blog, accessed on the Internet at http://makewindow.tumblr.com/page/4 on Aug. 18, 2016.

Make Window: an idea log of windows, window details, and ideas that make us rethink the way we make windows, blog entries from May 12, 2014 to May 30, 2016, p. 1 of 15 of blog, accessed on the Internet at http://makewindow.tumblr.com/ on Aug. 18, 2016.

Brighton LS Series Wood Window Quality and Performance, Nov. 11, 2014, Quaker Window Products, Freeburg, Missouri, US, downloaded from the Internet from http://quakerwindows.com/wp-content/uploads/2014/08/Quality-Performance.pdf on Aug. 18, 2016.

* cited by examiner

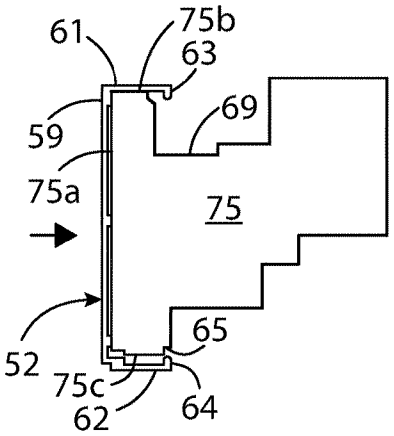
FIG. 9A
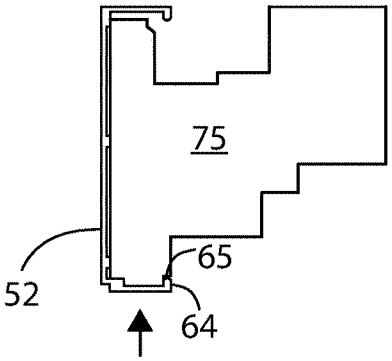
FIG. 9B
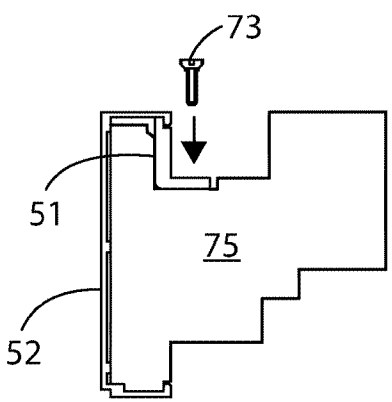
FIG. 9C
FIG. 9D
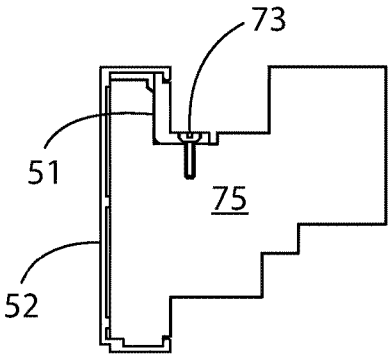
FIG. 9E

CLADDING SYSTEM FOR GLAZED DOORS AND WINDOWS

BACKGROUND

Glazed doors and windows (i.e. doors and windows with a glass panel) can be framed with a variety of materials. These include wood, fiberglass, polyvinyl chloride (PVC), or metal. Wood frames and wood sashes are generally more energy efficient than their all-metal frame and sash counterparts because wood is a better thermal insulator than metals such as aluminum or steel. In certain applications, wood frames are often chosen over metal for their natural appearance, especially within a building interior. A disadvantage of wood-framed doors and windows is that their frame and sash exteriors are vulnerable to sun and rain. These exterior surfaces can be "cladded," or covered with aluminum or other materials, to resist the elements and improve durability. The interior of the wood frame or sash can remain uncladded to retain its natural appearance.

In the United States, aluminum cladding is typically applied directly, and often permanently, to the surface of the wood frame or sash. American-style cladding is typically made of rolled or formed aluminum so it can easily be applied directly to the surface of the wood frame.

In Europe, there is a movement toward energy efficient aluminum-clad wood doors and windows with a pleasing architectural appearance. These are known in the art as Euro-style aluminum-clad wood door and windows or simply "Euro-clad." They often go by designations such as Euro-style IV 68, Euro-style IV 78, Euro-style IV 92, or Euro-style IV 110. The "IV" designation indicates insulated glass. The numerical designation such as 68, 78, 92, or 110 indicates the thickness in millimeters of wood frame and/or the wood sash. Euro-clad windows such as Euro-style IV 78 and thicker enjoy good frame and sash rigidity as well as better thermal and noise insulation because of the thickness of wood frames and sashes. Euro-style cladding often includes thick complex ribbing to add structural integrity and to provide air breaks between the cladding members and wood frame. Euro-style cladding is typically made of relatively thick extruded aluminum, and enjoys greater structural rigidity than thin rolled and formed aluminum found in American-style cladding.

SUMMARY

The inventors wanted to create a low-profile removable wood door and window cladding system with the style and thermal performance of a Euro-style system. They recognized that simply applying American-style cladding with thin rolled aluminum to a Euro-style door or window structure would have undesirable consequences. For example, because American-style cladding members are often secured with adhesive to the frame or sash, the cladding members would be difficult to remove. The structural integrity of the thin rolled aluminum cladding members of typical American-style cladding would be significantly less than the thick aluminum extrusion of Euro-style cladding. Moisture seepage under the thin rolled aluminum cladding members could cause delamination of the cladding from the frame or could rot the wood.

With this in mind, the inventors took a different approach to the problem. They did not apply cladding directly to the surface of the wood frame with adhesive, like with American-style cladding, or use button-style fasteners, which is common with Euro-style cladding. Instead, the inventors held a cladding member and a rigid L-shaped bracket onto a fenestration frame member by tension caused by flexing of the cladding member. The cladding member is self-supporting and composed of a resilient material typically aluminum, fiberglass, or composite. The L-shaped bracket is typically steel or aluminum and more rigid than the cladding member. The L-shaped bracket can also be made of other rigid materials, such as thermal plastic or PVC as long as the material has with sufficient strength to withstand the compressive forces of the cladding member without bending or cracking and is more rigid than the cladding member. While PVC or vinyl has disadvantages over steel or aluminum, it may be used in situations were reduction of moisture condensation is desirable. The fenestration frame member is typically a wood sash or wood frame member although could be made of other materials such as fiberglass, PVC, or a composite material.

The cladding member includes two opposing ends that approximately face each other. The tension is created when one end engages a groove in the fenestration frame member while the other end engages the L-shaped bracket positioned within the opposite end of the fenestration frame member. This combination creates clamping action between the cladding member, L-shaped bracket, and fenestration frame member as the L-shaped bracket is pivoted into position within an indentation in the fenestration frame member. The indentation prevents the L-shaped bracket from rotating out of position. Pivoting the L-shaped bracket into its final position initiates engagement of tension or holding forces between the elements. The tension is created because of the rigidity of the cladding and the L-shaped bracket resists flexing. The L-shaped bracket is generally more rigid than the cladding member so that cladding would tend to flex more than the L-shaped bracket. In addition, the cladding member includes thin inset portions and ribs to increase structural integrity and create small air pockets for insulation and moisture evaporation.

The system can be assembled by aligning the cladding member over the fenestration frame member followed by placing the cladding member into its final position by inserting one end of the cladding member into the groove along one side of the fenestration frame member. A grooved end on the top of the L-shaped bracket engages the opposite end of the cladding member. The L-shaped bracket is pivoted about the engaging end so that the bottom of the L-shaped bracket becomes positioned in an indentation, or recess, in the fenestration frame member. The indentation is on an opposite side of the fenestration frame member from the grooved surface. As the L-shaped bracket is rotated into to place, it has sufficient rigidity to create tension between the opposing ends of the cladding and the fenestration frame member. After the L-shaped bracket is rotated into the indentation, a threaded fastener can secure the L-shaped bracket to the fenestration frame member.

This cladding system has several unexpected results. (1) The strength of the cladding member, in combination with the fenestration frame member, is comparable to cladding systems with cladding members of much greater thickness. (2) The L-shaped bracket, the cladding member, and fenestration frame member, in combination, hold the cladding member rigidly in place, reinforce the fenestration frame member, and prevent both the fenestration frame member and the cladding member from bending or twisting. (3) The sightline is improved as compared with typical Euro-style aluminum-clad wood openings. Euro-clad systems typically depend on a cladding member to support the outside edge of the glass panel. Consequently, the cladding member must have sufficient height and structure to support the weight and forces exerted by the bottom edge of the glass panel. In contrast, the cladded fenestration frame opening of developed by the inventors does not depend on the cladding member to hold the glass panel in place. Instead, the glass panel is held between an outward projected portion of the fenestration frame member on one side of the glass and a glazing stop on the other. The L-shaped bracket reinforces the outward projected portion of the fenestration frame member.

The inventors envision that the cladding system, using the principles described in this Summary and the Description, can readily be applied to many types of fenestration frame openings. These include, but are not limited to: inswing, outswing, sliding, and folding doors and windows; fixed light, single hung, double hung, casement, and awning windows; and curtain walls. While originally conceived for wood frames and sashes in combination with aluminum cladding, the inventors envision that the principles described in this Summary and the Description can readily be applied to other fenestration frame materials, such as fiberglass, PVC, or composites; and other cladding materials, such as fiberglass, PVC, composites, or other metals.

This Summary has introduced a selection of concepts, in simplified form, to help the reader understand and appreciate aspects of the inventive concept. This not intended to limit the scope of the claimed subject matter.

DRAWINGS

FIG. 9A-9E shows a sequence of steps similar to FIG. 7 as applied to securing a cladding member to the frame associated with the sash member of FIGS. 8A-8F;

DESCRIPTION

Figure 1:
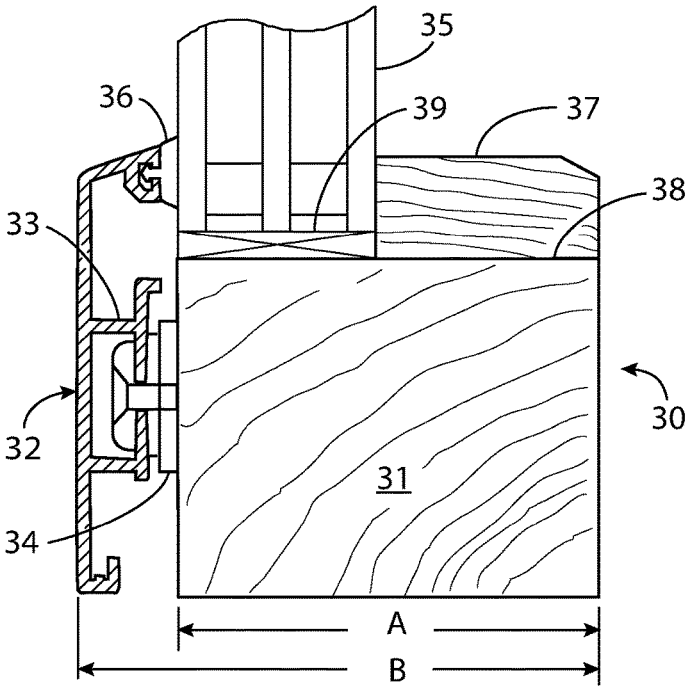
FIG. 1 Prior Art
FIG. 1 shows a cross-section of a Euro-style aluminum-clad wood frame for a fixed light opening in the prior art.

The following terms are used throughout this disclosure and are defined here for clarity and convenience.

Cladding Member: As defined in this disclosure, a cladding member is a partial or full covering over the door or window frame or sash. The covering can be removable or non-removable. The covering is often of a different material than the frame or sash. For example, for aluminum-clad wood doors or windows, the cladding members are made of aluminum and the door or window frames and/or sashes are made of wood. The cladding member is typically made of aluminum but can be made of other materials such as fiberglass, PVC, or composites.

Fenestration: As defined in this disclosure, a fenestration refers to a glazed opening (i.e. an opening that includes a glass panel) such as a door or window. The opening may include a movable or openable component. For example, an inswing or outswing door or window includes a movable glass panel surrounded by a sash. The opening may alternatively be fixed and non-openable; for example, a fixed light.

Fenestration Frame Member: As defined in this disclosure, a fenestration frame member refers a frame member or a sash member. A cladded fenestration frame member is typically made of wood. However, the fenestration frame member not limited to being wood. It can also be made of other frame or sash materials, for example, fiberglass, PVC, or composite materials. The frame members 53 of FIGS. 2-6F, 12-13, and 17; the sash members 74 of FIGS. 8A-F 12-16, and 19-25; the door/window frame members 75 of FIGS. 9A-E, 12-16, 19, 20, 22, 23, and 25; the frame members 76 of FIGS. 12-16, 18 and 19; and the sill frame member 94 of FIGS. 27A-E are fenestration frame members.

Fixed Light: As defined in this disclosure, a fixed light or fixed light opening is a window that does not open.

Frame: As defined in this disclosure, a frame refers to the stationary portion of the door or window that encloses the sash. For stationary, fixed light, or "direct glaze" openings, the frame refers the fixed portion of the door that surrounds the glass panel. The frame is generally comprised of frame members. A frame member can be a horizontal (head or sill) or vertical portion (side jambs) of the frame.

Glazing Stop: As defined in this disclosure, a glazing stop includes a removable rigid member or molding with optional cushioning material that holds a glass panel in the frame or sash. The rigid member can be made of wood, metal, plastic, or other rigid materials. The glazing stop can include gasketing or other cushioning material to buffer direct contact between the rigid member and the glass panel.

Head: As defined in this disclosure, a head, or head jamb, refers to a top member of a frame.

Jamb: As defined in this disclosure, a jamb refers to a frame member forming the top (head jamb), bottom (sill jamb), or sides (side jambs) of a door or window opening.

Sash: As defined in this disclosure, a sash refers a frame surrounding a glass panel that together with the glass panel forms the movable part of the window or door. A sash member refers to a horizontal or vertical portion of a sash.

Sill: As defined in this disclosure, a sill, or sill jamb, refers to the bottom of the frame that generally rests on the floor.

Slightline: As defined in this disclosure, a sightline is visual feature of a window or door that measures the amount of frame viewable by an observer. For a given sized door or window, a narrower sightline means that more of the glass panel is exposed.

Stop Block: As defined in this disclosure, a stop block is a cushioning member placed between the glass panel and the sash or frame. Stop blocks are often rectangular and can be made of a material with elastic properties such as ethylene propylene diene monomer (EPDM), polycholorprene (neoprene), rubber, or silicone or other flexible materials suitable for supporting the weight of a glass panel and cushioning it from breakage when secured against a frame or sash.

The terms "left", "right", "top", "bottom", "upper", "lower", "vertical", "horizontal", "front", "back", and "side" are relative terms used throughout the to help the reader understand the figures. Unless otherwise indicated, these do not denote absolute direction or orientation and do not imply a particular preference. Specific dimensions are intended to help the reader understand the scale and advantage of the disclosed material. Dimensions given are typical and the claimed invention is not limited to the recited dimensions.

FIG. 1 shows a cross-section of a portion of a Euro-style aluminum-clad wood opening 30 in the prior art. The width of the wood frame member 31 is depicted by width A. The width of the entire profile including a Euro-style cladding member 32 is depicted by width B. Width A is typically a standard width. For example, for Euro-style IV 78, width A is 78 millimeters. For Euro-style IV 92, width A is 92 millimeters. For Euro-style IV 110, width A is 110 millimeters. Wood frame member 31 that are thicker typically have greater structural rigidity and better insulation performance. For a Euro-style cladding member 32 that is 20 millimeters thick and for Euro-style IV 78, the total profile width B would be 98 millimeters.

The Euro-style cladding member 32 can typically be made of extruded aluminum with the ribbing 33 providing additional rigidity and strength. The Euro-style cladding member 32 is shown secured to the wood frame member 31 by button fastener 34. The glass panel 35 of the Euro-style aluminum-clad wood opening 30 is held securely between a gasket 36 that is secured to the Euro-style cladding member 32 and a glazing stop 37. The gasket 36 cushions the glass panel 35 from the Euro-style cladding member 32 and provides a moisture barrier between the Euro-style cladding member 32 and glass panel 35 in order to protect the wood frame member 31 from the elements. The glazing stop 37 shown in FIG. 1 is made of wood. The glazing stop 37 can alternatively be made of metal in combination with a gasket, plastic, fiberglass, or other rigid materials suitable to structurally support the bottom edge of the glass panel 35. The glass panel 35 is supported and cushioned above the wood frame member top surface 38 by a stop block 39. The glass panel 35 is depicted as tripled glazed with three panes of glass separated by spacers.

Figure 2:
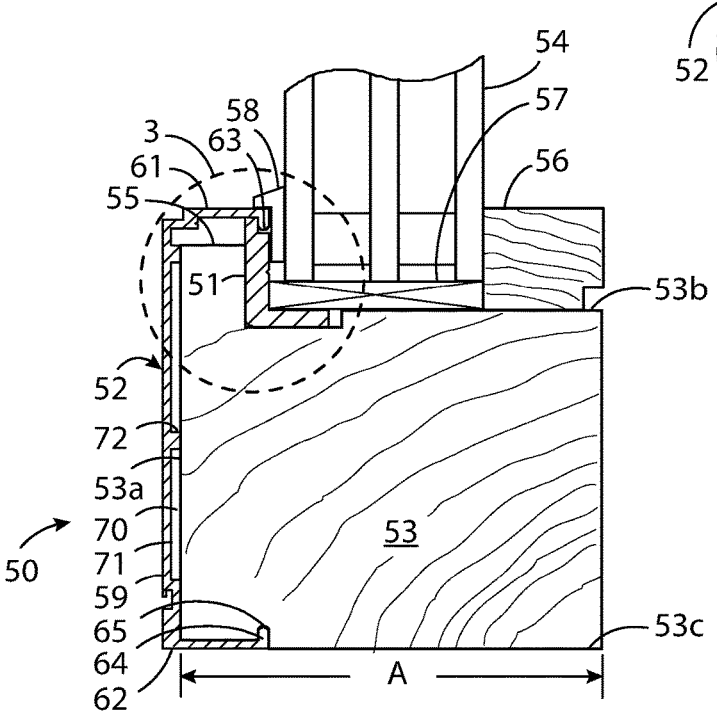
FIG. 2 shows a cross-section of a cladded frame of the present disclosure taken along section lines 2-2 from FIG. 11.

The Euro-style aluminum-clad wood opening 30 of FIG. 1 provides a rigid structure for supporting the glass panel 35 and protection from wind and rain. The inventors wanted to create a cladded wood doors and window with nearly the same width and thermal performance of their non-cladded wood frame door and window counterparts. The inventors discovered that they could create cladding that did not significantly increase the profile of the wood frame or wood sash, while maintaining comparable thermal performance, structural integrity, and moisture resistance. They were able to accomplish this, as depicted in FIG. 2, by using an L-shaped bracket 51 in combination with a cladding member 52 that is structured and positioned with the respect a frame member 53 to exert pressure against the frame member 53 in opposite directions, and optionally, along the same plane. FIG. 2 shows a cross-section of a portion of the cladded fenestration frame opening 50 of the present disclosure taken along section lines 2-2 from FIG. 11. FIG. 2 embodies elements of the inventive concept that apply not just to the frame member 53 depicted, but to other fenestration frame members (i.e. both frame members and sash members made of wood or other materials such as PVC, fiberglass, or composite materials), as will be illustrated and described in the remainder of this disclosure. The wood frame member 31 of FIG. 1 and the frame member 53 are illustrated with the same width A, and both made of wood, with the cladding member 52, made of aluminum. This was done to clearly contrast how much narrower that cladded fenestration frame opening 50 of FIG. 2 is in comparison with the Euro-style aluminum-clad wood opening 30 of FIG. 1 using the same materials. Typically the cross-sectional thickness of the cladding member 52 can be 0.06 inches (1.5 millimeters) to 0.11 inches (2.7 millimeters), but is not limited to this range. For a frame member 53 with a width A=78 millimeters, the total profile width could be approximately 80 millimeters.

The reader should note that while the fenestration frame member of FIGS. 2 and throughout the remainder of the figures are portrayed as wood, they are not limited as such. They can readily be made of fiberglass, PVC, or composite materials.

The structure depicted in FIG. 2 and throughout the remainder of this disclosure, embodies elements of the inventive concept that produce several unexpected results. Referring to FIG. 2, for a given combination of materials, the strength of the cladding member 52 in combination with the frame member 53 are comparable to cladding systems of much greater thickness. The L-shaped bracket 51, the cladding member 52, and frame member 53 structural combination holds the cladding member 52 rigidly in place, reinforces the frame member 53, and prevents both the frame member 53 and the cladding member 52 from bending or twisting. The sightline is improved as compared with the Euro-style aluminum-clad wood opening 30 of FIG. 1. In FIG. 1, the Euro-style cladding member 32 needs sufficient height and structure to support the weight and forces exerted by the bottom edge of the glass panel 35. In contrast, the cladded fenestration frame opening 50 of the present disclosure, depicted in FIG. 2, does not depend on the cladding member 52 to hold the glass panel 54 in place. Instead, the glass panel 54 is held between an outward projected portion 55 of a first side surface 53*b* of the frame member 53, or fenestration frame member, and a glazing stop 56. The outward projected portion 55 of the frame member 53 is reinforced by the L-shaped bracket 51. The L-shaped bracket 51 is made of a rigid material able to withstand the compression forces of the cladding member 52, typically formed or extruded aluminum, or formed or extruded steel. For either aluminum or steel, the typical thickness of the L-bracket can be 0.12 inches (3.0 millimeters) to 0.18 inches (4.6 millimeters) but is not limited to this range. While the L-shaped bracket 51 can be made of the same material as the cladding member 52, the L-shaped bracket 51 would typical be thicker for a given material in order to make it more rigid in comparison to the cladding member 52. The L-shaped bracket 51 can be made of other rigid materials, such as thermal plastic or PVC as long as the material is able to withstand the compressive forces of the cladding member 52. The bottom surface of the glass panel 54 is cushioned from the frame member 53 and supported by a stop block 57. The side of the glass panel 54 is cushioned from the L-shaped bracket 51 and the outward projected portion 55 by a glazing gasket 58. Glazing gaskets 58 are constructed of a resilient water resistant material such as EPDM. Silicone-glazing sealant, glazing tape, or other resilient water resistant material window weather seal materials could be readily substituted for the glazing gasket 58.

The cladding member 52 of FIG. 2, and of the remaining figures is illustrated as approximately C-shaped. A main body 59 forms the body of the C, a first arm 61 and second arm 62 forms the arms of the C, and the a first end 63 and a second end 64 forms the serifs of the C. The main body 59 covers the outward-facing surface 53*a* of the frame member 53. The first arm 61 projects inwardly away from one end of the main body 59 and covers the outward projected portion 55. The second arm 62 projects inwardly away from opposite end of the main body 59 and covers a portion of a second side surface 53*c* of the frame member 53. The first end 63 projects directly away from the first arm 61 and downward toward the first side surface 53*b* of the frame member 53. The second end 64 projects directly away from the second arm 62 and upward toward the second side surface 53*c* of the frame member 53 where it engages a groove 65 along the second side surface 53*c*. The first end 63 and the second end 64 project along a path parallel to the plane of the main body 59. As illustrated, the first end 63 and the second end 64 project directly toward each other and in the same plane in order to maximize the clamping force. Alternatively, the first end 63 and the second end 64 can be offset and project along parallel planes.

Figure 3:
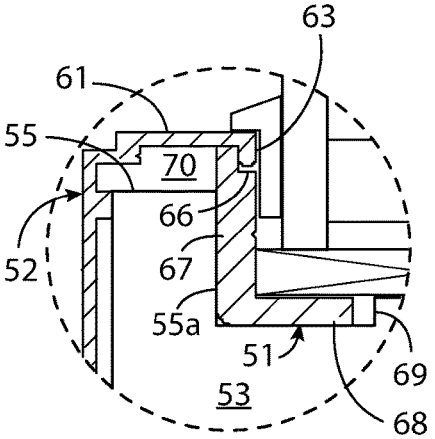
FIG. 3 shows a portion of FIG. 2 detailing the L-shaped bracket and the first end of the cladding member.

In FIG. 3, the first end 63 and L-shaped bracket 51 are shown in greater detail. The first end 63 engages a grooved end 66 along the end of the first leg 67 of the L-shaped bracket 51. The second leg 68 of the L-shaped bracket 51 is pressed against an indentation 69 in the top of the frame member 53 by the opposing forces exerted by the first end 63 (FIGS. 2-3) and the second end 64 (FIG. 2). The height of the L-shaped bracket 51 and the depth of the indentation 69 in combination are sized to create tension force in the cladding member 52. The first leg 67 of the L-shaped bracket 51 engages a projection side surface 55*a* that projects perpendicularly away from the indentation 69. The first arm 61, L-shaped bracket 51, and the outward projected portion 55 of the frame member 53 are positioned and constructed to create an air pocket 70 between the first arm 61 and the outward projected portion 55. This creates a moisture barrier and provides insulation between the cladding member 52 and frame member 53.

Referring back to FIG. 2, the main body 59 of the cladding member 52 includes inset portions 71 separated by ribs 72. The ribs 72 provide the cladding member 52 with additional structural integrity and rigidity and define air pockets 70. These air pockets 70 also help create a moisture barrier and provides for insulation between the cladding member 52 and frame member 53.

Figure 4:
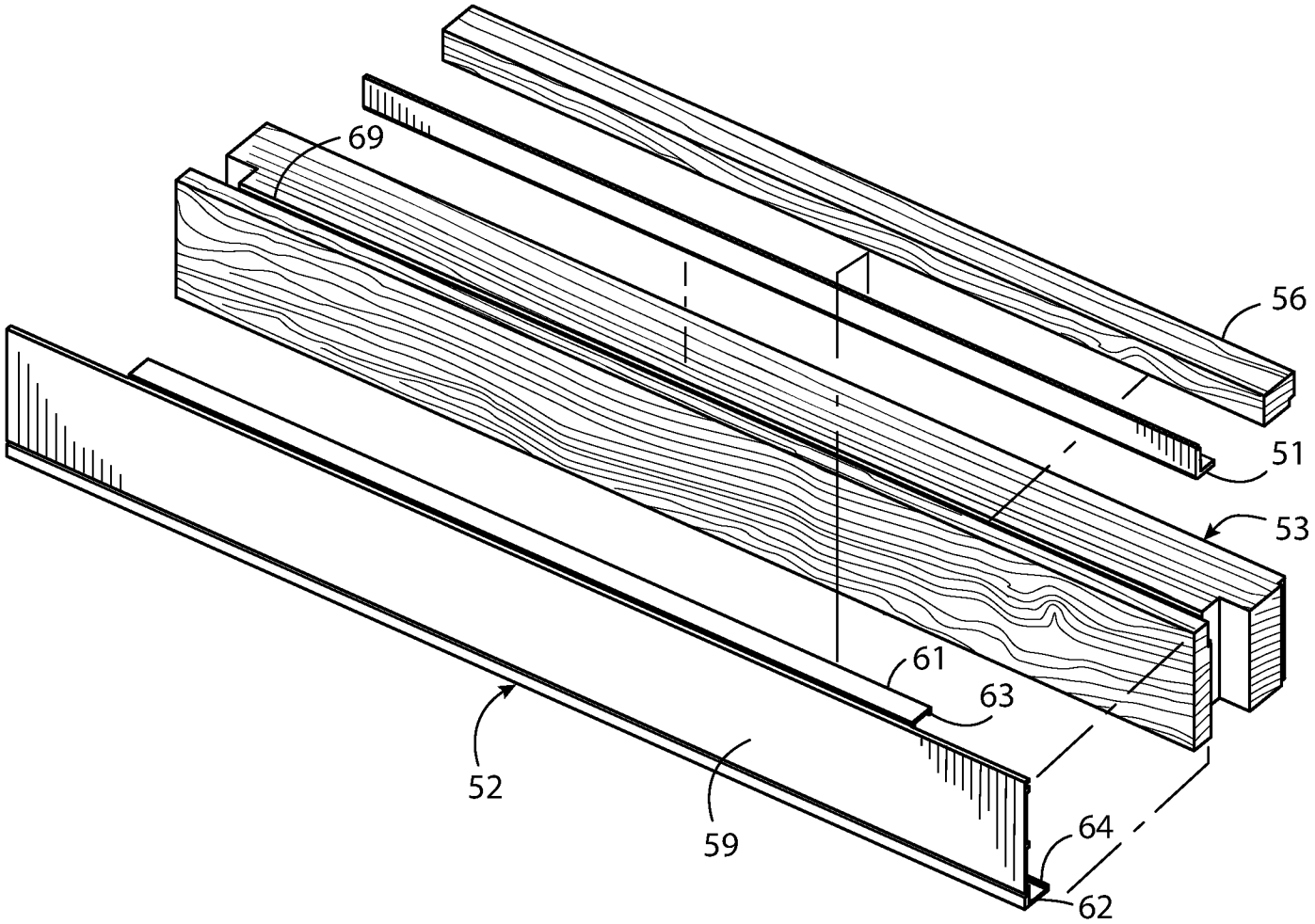
FIG. 4 shows an exploded perspective view of the cladding member and frame member of FIG. 2.
Figure 5:
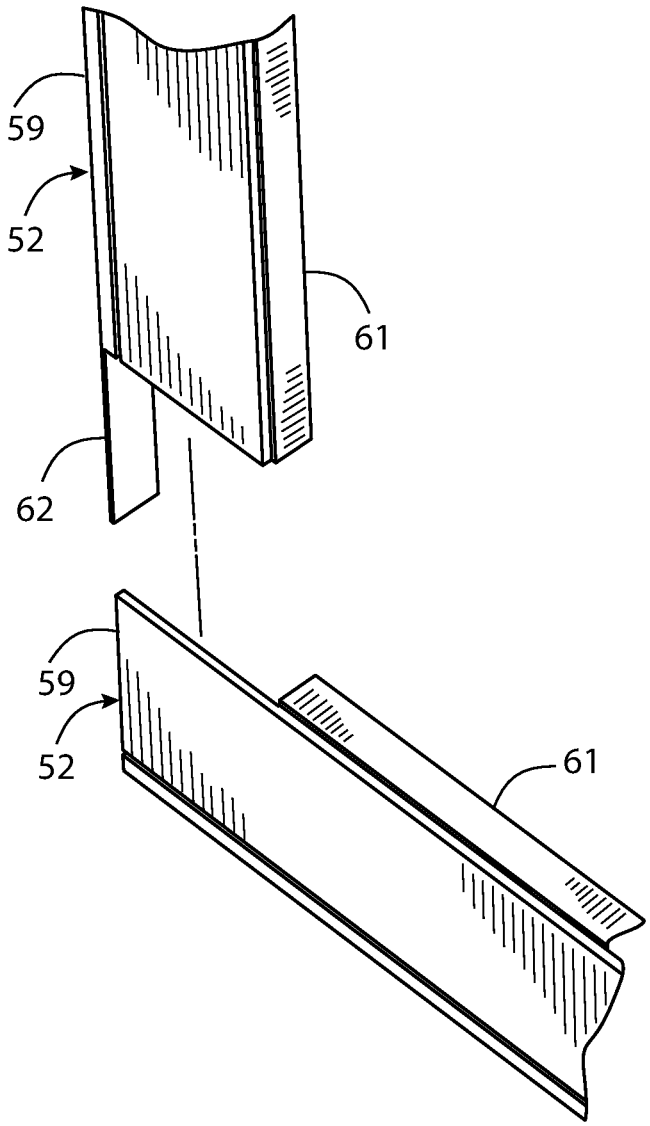
FIG. 5 shows an exploded perspective view of a portion of the cladding member of FIG. 2 in relation to a portion of vertical cladding member.

FIG. 4 shows an exploded perspective view of the cladding member 52 and frame member 53 of FIG. 2 illustrating the L-shaped bracket 51, the frame member 53, the cladding member 52, and the glazing stop 56. The stop block 57 of FIG. 2 is hidden from view in FIG. 4 but seated within the indentation 69. The glass panel 54 of FIG. 2 is omitted for simplicity. The L-shaped bracket 51 is illustrated extending the length of the first arm 61. However, one or more shorter versions of the L-shaped brackets 51 can be substituted according to the required strength vs. assembly convenience. A longer version of the L-shaped bracket 51 is stronger while one or more of the shorter versions of the L-shaped brackets 51 might be more convenient. The second end 64 projects upward out of the second arm 62. Both extend the entire length of the main body 59 of the cladding member 52. The first end 63 projects download out of the first arm 61. Both are illustrated not extending the entire length of the main body 59. Referring to FIG. 5, the purpose for the first arm 61 not extending the entire length of the main body 59 is to interconnect the cladding member 52 of the vertical frame member.

FIG. 5 shows an exploded perspective view of a portion of the cladding member 52 of FIG. 4 in relation to a portion of the cladding member 52 associated with the vertical frame member (not shown). In FIG. 5, the main body 59 of the cladding member 52 extending horizontally in the figure (i.e. the cladding member 52 associated with FIG. 4) extends beyond the first arm 61 approximately the width of the main body 59 of the cladding member 52 shown vertically. The second arm 62 of the cladding member 52 depicted vertically, extends approximately the height of the cladding member 52 depicted horizontally. The first arm 61 and main body 59 of the cladding member 52 are illustrated vertically terminate together. This arrangement allows the cladding members 52 oriented horizontally and vertically to interconnect while covering the surface of their respective frame members 53 (not shown) without gaps.

Figure 6A:
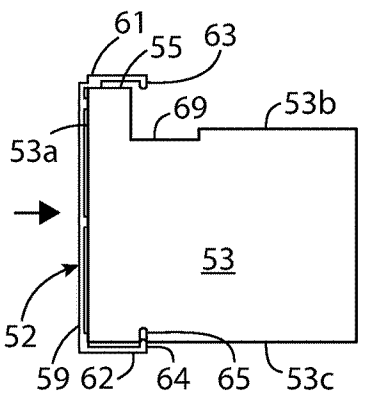
FIGS. 6A-6F shows a sequence of steps for securing the cladding member and the glass panel to the frame member.
Figure 6B:
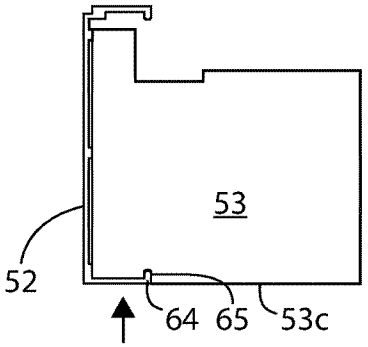
Figure 6C:
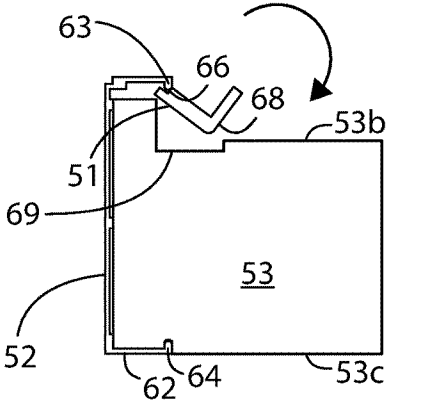
Figure 6D:
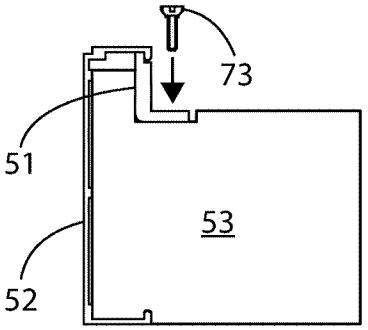
Figure 6E:
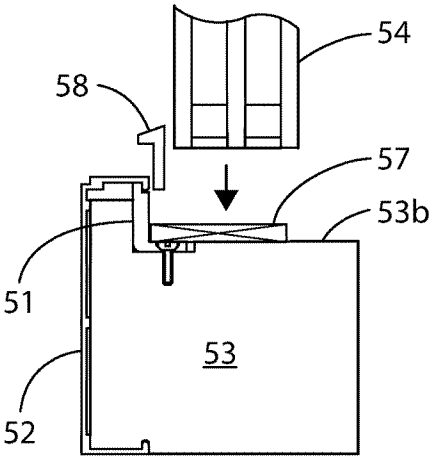
Figure 6F:
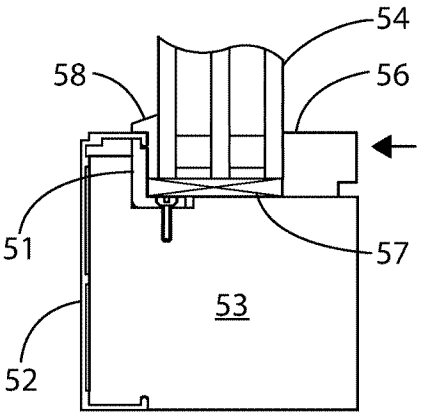
Figure 7:
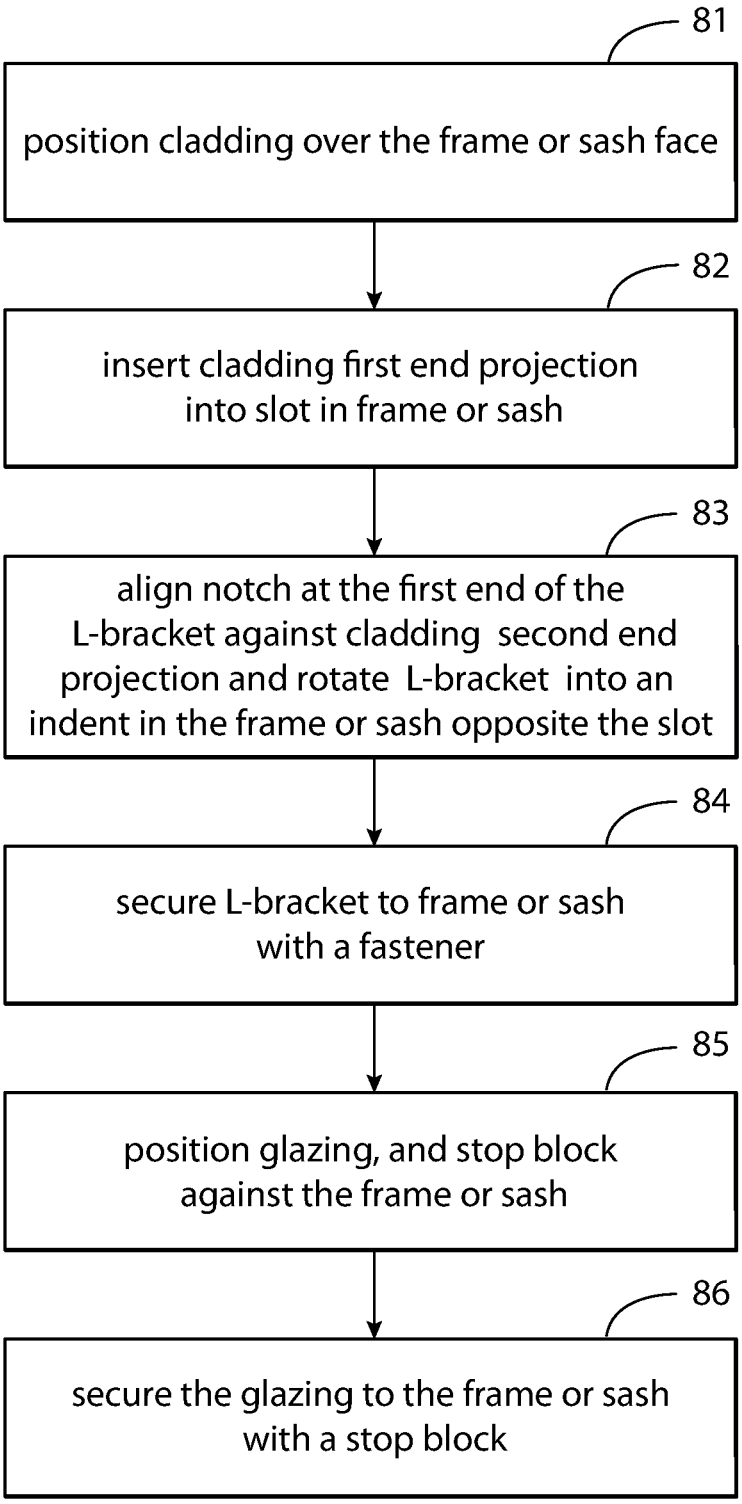
FIG. 7 shows a flow chart illustrating the sequence of steps from FIGS. 6A-6F.

The assembly sequence of FIGS. 6A-6F and accompanying flow chart of FIG. 7 helps highlight and explain aspects the unique combination and arrangement of L-shaped bracket 51 of FIGS. 6C-F, with the cladding member 52 and frame member 53 of FIGS. 6A-6F. In step 81 of FIG. 7 and as illustrated in FIG. 6A, the main body 59 of the cladding member 52 is positioned over outward-facing surface 53*a* of the frame member 53 and the second end 64 of the second arm 62 of the cladding member 52 is positioned over the groove 65 of the second side surface 53*c* of the frame member 53. The first arm 61 of the cladding member 52 is positioned over the outward projected portion 55 of the first side surface 53*b* of the frame member 53. The first end 63 of first arm 61 of the cladding member 52 is positioned over the indentation 69 in the first side surface 53*b*.

In step 82 of FIG. 7, and as illustrated in FIG. 6B, the second end 64 of the cladding member 52 is inserted into groove 65. Both the second end 64 and the groove 65 can extend the entire length of the second side surface 53*c* the frame member 53.

In step 83 of FIG. 7, and as illustrated in FIG. 6C, the grooved end 66 of the L-shaped bracket 51 is engages the first end 63 of the cladding member 52. Once engaged, the L-shaped bracket 51 is rotated in the indentation 69 in the first side surface 53*b* of the frame member 53. The length of the L-shaped bracket 51, position of the first end 63, and the depth of the indentation 69 are such, that when the L-shaped bracket 51 is rotated into the indentation 69, the combination creates a tight friction fit between the indentation 69 and the second leg 68 of the L-shaped bracket 51. This arrangement creates a clamping force between the first end 63 via the L-shaped bracket 51 and the second end 64 into the frame member 53. Both the first end 63 and the second end 64 are shown aligned to each other and perpendicular to surface of the indentation 69 (i.e. the first side surface 53*b*) and to the second side surface 53*c* of the frame member 53. The second leg 68 of the L-shaped bracket 51 aligned in the same plane as the indentation 69. The second arm 62 of the cladding member 52 is aligned in the same plane as the bottom surface of the frame member 53. This arrangement increases clamping force by increasing the surface area of clamping and positioning the planes of engagement perpendicular to the clamping force.

In step 84 of FIG. 7, and as illustrated in FIG. 6D, a threaded fastener 73 secures the L-shaped bracket 51 and the cladding member 52 to the frame member 53 through an aperture in the L-shaped bracket 51 (aperture not illustrated). The threaded fastener 73 can be a screw, bolt, or any threaded fastener, known in the art, suitable for fastening the L-shaped bracket 51 to the frame member 53 and being about to withstand the rotational forces on the cladding member 52 from the outside environment and day-to-day use.

In step 85 of FIG. 7, and as illustrated in FIG. 6E, a stop block 57, a glass panel 54, and a glazing gasket 58 are positioned for assembly with the cladding member 52 and frame member 53 assembly. The stop block 57 cushions and protects the bottom of the glass panel 54 from the L-shaped bracket 51 and the first side surface 53*b* of the frame member 53. The glazing gasket 58 provides water protection and cushions the bottom edge of the outside face of the glass panel 54 from the L-shaped bracket 51 and the cladding member 52. As previously described, the glazing gasket 58 can typically made of an elastic or resilient water resistant material such as EPDM. The glazing gasket 58 can be replaced by glazing tape, silicone-glazing sealant, or an equivalent water resistant cushioning material designed for glazing applications.

In step 86 of FIG. 7, and as illustrated in FIG. 6F, a glazing stop 56 is inserted against the inside face of the glass panel 54. The cladding member 52, L-shaped bracket 51, stop block 57, glass panel 54, and glazing gasket 58 are shown in their assembled configuration. The glazing stop 56 illustrated in FIG. 6F is made of wood and typically fastened in accordance with door and window industry practices, for example with nails. The glazing stop 56 could be made of other rigid materials as previously described and fastener in a many consistent with door and window industry practices. The glazing stop 56 is shown contacting inside surface of the glass panel 54 directly. A glazing gasket can optionally be used to cushion the glass panel 54 from the glazing stop 56.

The frame member 53 of FIGS. 2-6F are typical of head jambs and sill jambs of framed glass panels that do not open. A framed glass panel that does not open (i.e. is fixed) is known as a fixed light. The same principles can be applied to other fenestration frame members. FIG. 8A-8F shows the same sequence of steps from FIG. 7 as applied to securing the cladding member 52 and a glass panel 54 (FIGS. 8E-F) to a sash member 74 of a glass door or window. The assembly sequence illustrated in FIGS. 8A-8F is for the sash member 74 at the top of the glass door or window. The same assembly sequence also applies to the vertical sashes and the sill sash.

Figure 8A:
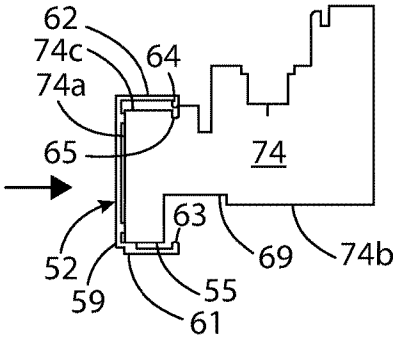
FIG. 8A-8F shows the same sequence of steps from FIG. 7 as applied to securing the cladding member and the glass panel to a top sash with the same principle also applying to the vertical side sashes and the sill sash.
Figure 8B:
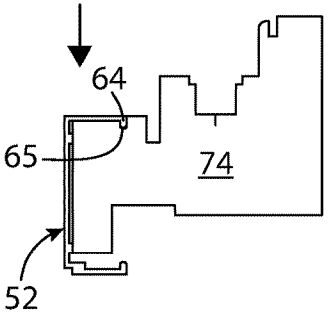
Figure 8C:
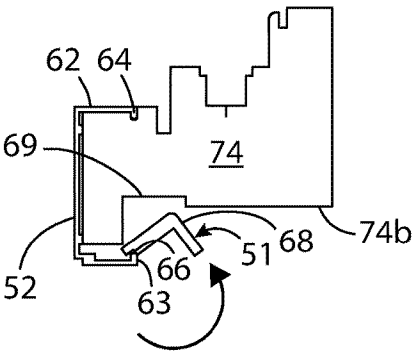
Figure 8D:
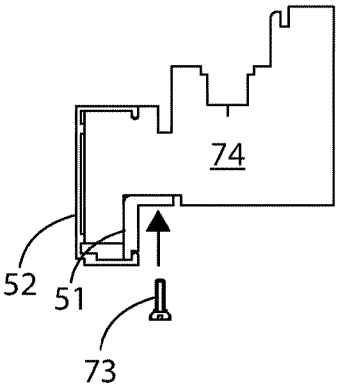
Figure 8E:
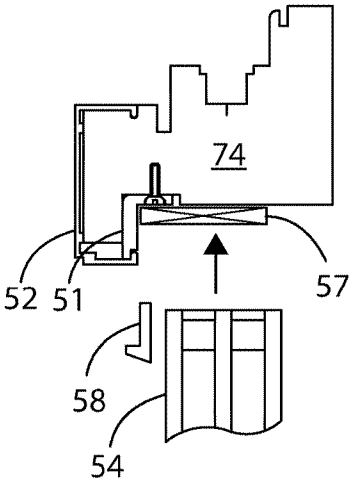
Figure 8F:
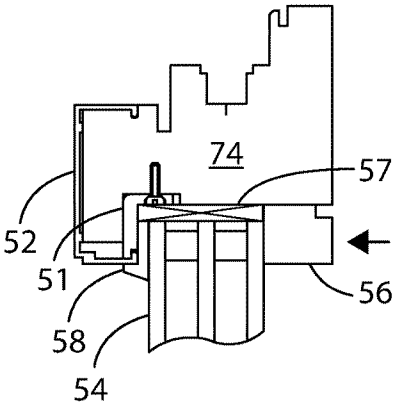

In FIG. 8A, the main body 59 of the cladding member 52 is positioned over the outward-facing surface 74*a* of the sash member 74 and the second end 64 of the second arm 62 of the cladding member 52 is positioned over the groove 65 in the second side surface 74*c* of the sash member 74. The first arm 61 of the cladding member 52 is positioned over the outward projected portion 55 of the first side surface 74*b* of the sash member 74. The first end 63 of the first arm 61 is positioned over the indentation 69 in the first side surface 74*b*. In FIG. 8B, the second end 64 of the cladding member 52 is inserted into groove 65. As with the frame member 53 of FIG. 6B, the second end 64 can extend the entire length of the sash member 74. In FIG. 8C, the grooved end 66 of the L-shaped bracket 51 engages the first end 63 of the cladding member 52. Once engaged, the L-shaped bracket 51 is rotated in the indentation 69 in the first side surface 74*b* of the sash member 74. The length of the L-shaped bracket 51, position of the first end 63, and the depth of the indentation 69 are such, that when the L-shaped bracket 51 is rotated into the indentation 69, the combination creates a tight friction fit between the indentation 69 and the L-shaped bracket 51. This arrangement creates a clamping force between the first end 63 via the L-shaped bracket 51 and the second end 64 into the sash member 74. Both the first end 63 and the second end 64 are shown aligned to each other and perpendicular to surface of the indentation 69 and to the top surface of the sash member 74. The second leg 68 of the L-shaped bracket 51 is aligned in the same plane as the indentation 69. The second arm 62 of the cladding member 52 is aligned in the same plane as the top surface of the sash member 74. As described for FIGS. 6A-F, this arrangement increases clamping force by increasing the surface area of clamping and positioning the planes of engagement perpendicular to the clamping force. In FIG. 8D, a threaded fastener 73 secures the L-shaped bracket 51 and the cladding member 52 to the sash member 74 through an aperture in the L-shaped bracket 51 (aperture not illustrated). In FIG. 8E, a stop block 57, a glass panel 54, and a glazing gasket 58 are positioned for assembly with the cladding member 52 and sash member 74 assembly. In FIG. 8F, a glazing stop 56 is inserted against the inside face of the glass panel 54 and can be secured as previously described. The cladding member 52, L-shaped bracket 51, stop block 57, glass panel 54, and glazing gasket 58 are shown in the assembled configuration.

The same principle for applying cladding member 52 to the wood frame element of FIGS. 6A-6F and the sash member 74 of FIGS. 8A-8F also apply the head and door/window frame members 75 (vertical jambs) of FIGS. 9A-F that surrounds the sash members 74 of FIGS. 8A-8F. As illustrated FIG. 10, the steps for assembling the cladding member 52 to the door/window frame member 75 of FIGS. 9A-E are identical to the steps of FIG. 7 except for omission of the glass panel assembly steps.

Figure 10:
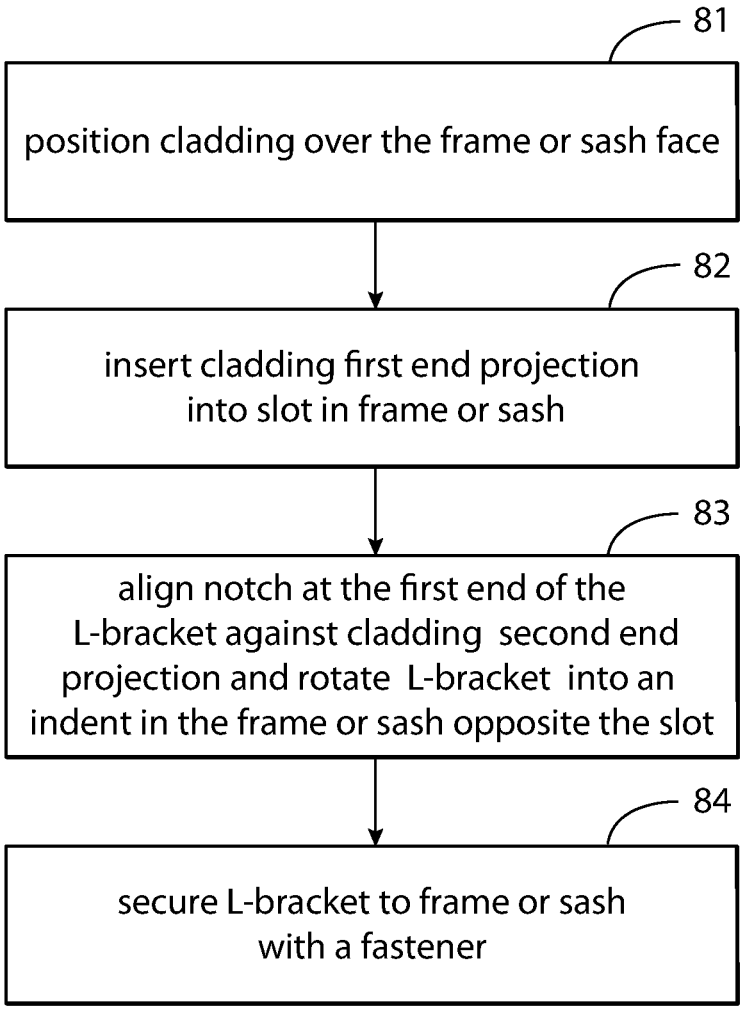
FIG. 10 shows a flow chart illustrating the sequence of steps from FIGS. 9A-9F.

Referring to step 81 of FIG. 10 and the assembly illustrated in FIG. 9A, the main body 59 of the cladding member 52 is positioned over the outward-facing surface 75*a* of the door/window frame member 75 and the second end 64 of the second arm 62 is positioned over the groove 65 of the second side surface 75*c*. The first end 63 of the first arm 61 is positioned over the indentation 69 in the first side surface 75*b*. In step 82 of FIG. 10 and as illustrated in FIG. 9B, the second end 64 of the cladding member 52 is inserted into groove 65. Here, the groove 65 is illustrated a rectangular notch in the edge on the cladded portion of the door/window frame member 75 inside edge. The groove 65 is not limited to this structure and can be any groove 65 capable of receiving and holding the second end 64 and cladding member 52 in place under normal use. As previously discussed, the second end 64 can extend the entire length of the door/window frame member 75. In step 83 of FIG. 10 and as illustrated in FIG. 9C, the grooved end 66 of the L-shaped bracket 51 is engages the first end 63 of the cladding member 52. Once engaged, the L-shaped bracket 51 is rotated in the indentation 69 in the top surface (as viewed in FIG. 9C) of the door/window frame member 75. The length of the L-shaped bracket 51, position of the first end 63, and the depth of the indentation 69 are such, that when the L-shaped bracket 51 is rotated into the indentation 69, the combination creates a tight friction fit between the indentation 69 and the L-shaped bracket 51. This arrangement creates a clamping force between the first end 63 via the L-shaped bracket 51 and the second end 64 into the door/window frame member 75 with the first end 63, the second end 64, surface of the indentation 69, second leg 68 of the L-shaped bracket 51 all aligned and arranged as previously described to increase clamping force by increasing the surface area of clamping and positioning the planes of engagement perpendicular to the clamping force. In step 84 of FIG. 10, and as illustrated in FIG. 9D, a threaded fastener 73 secures the L-shaped bracket 51 and the cladding member 52 to the door/window frame member 75 through an aperture in the L-shaped bracket 51 (aperture not illustrated). FIG. 9E illustrates the final assembly the cladding member 52, L-shaped bracket 51, the threaded fastener 73, and the door/window frame member 75 in combination.

Figure 11:
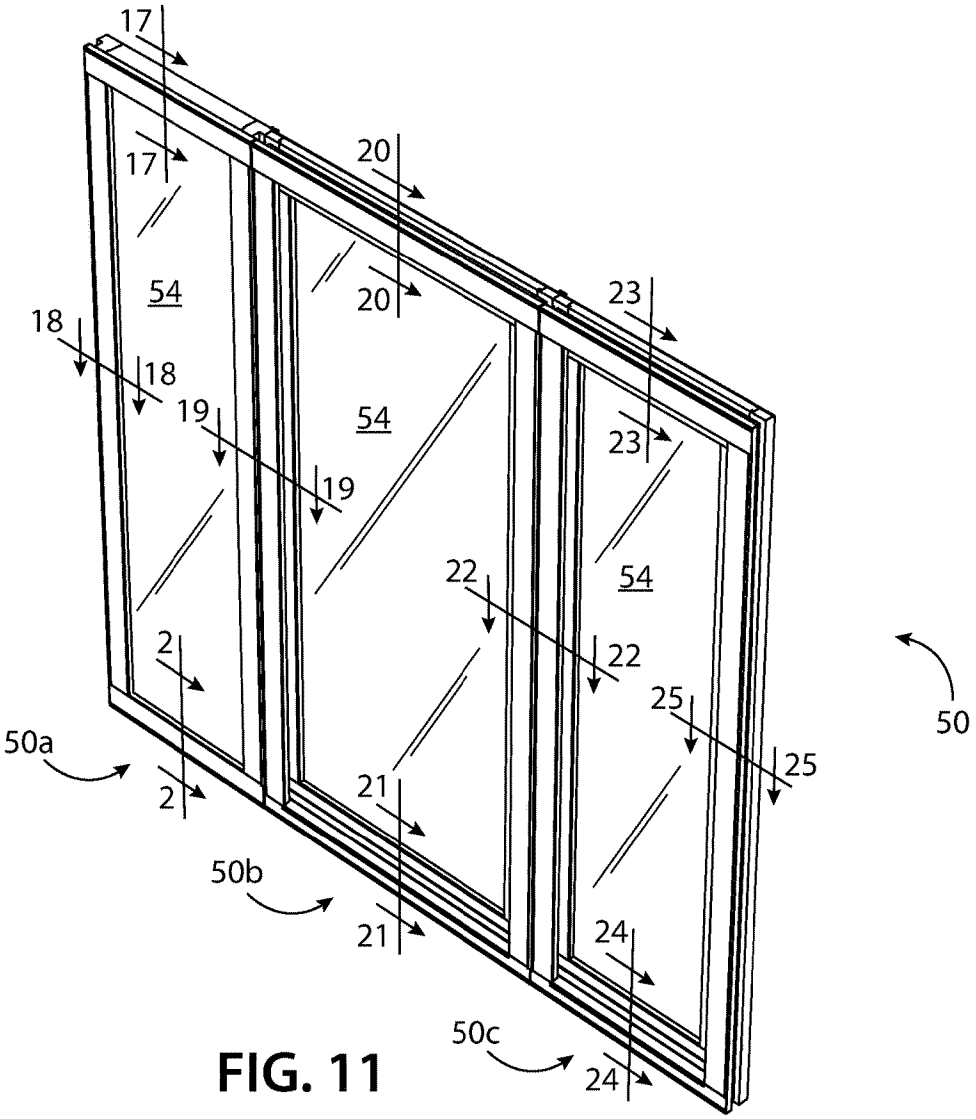
FIG. 11 shows a perspective view of a typical configuration of a cladded opening of the present disclosure including a fixed light opening, an inswing door opening, and an inswing window opening in combination.
Figure 12:
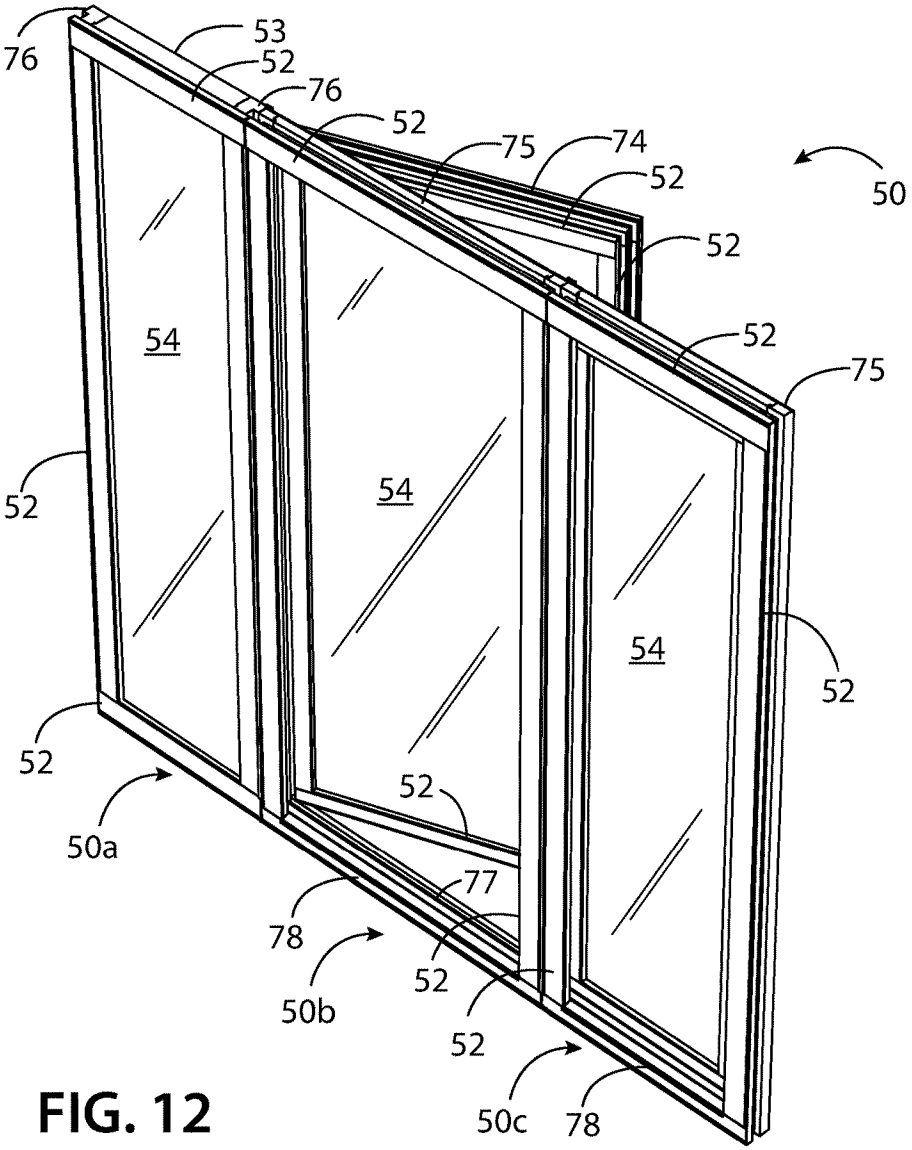
FIG. 12 shows the cladded opening of FIG. 11 with the inswing door portion partially open.
Figure 13:
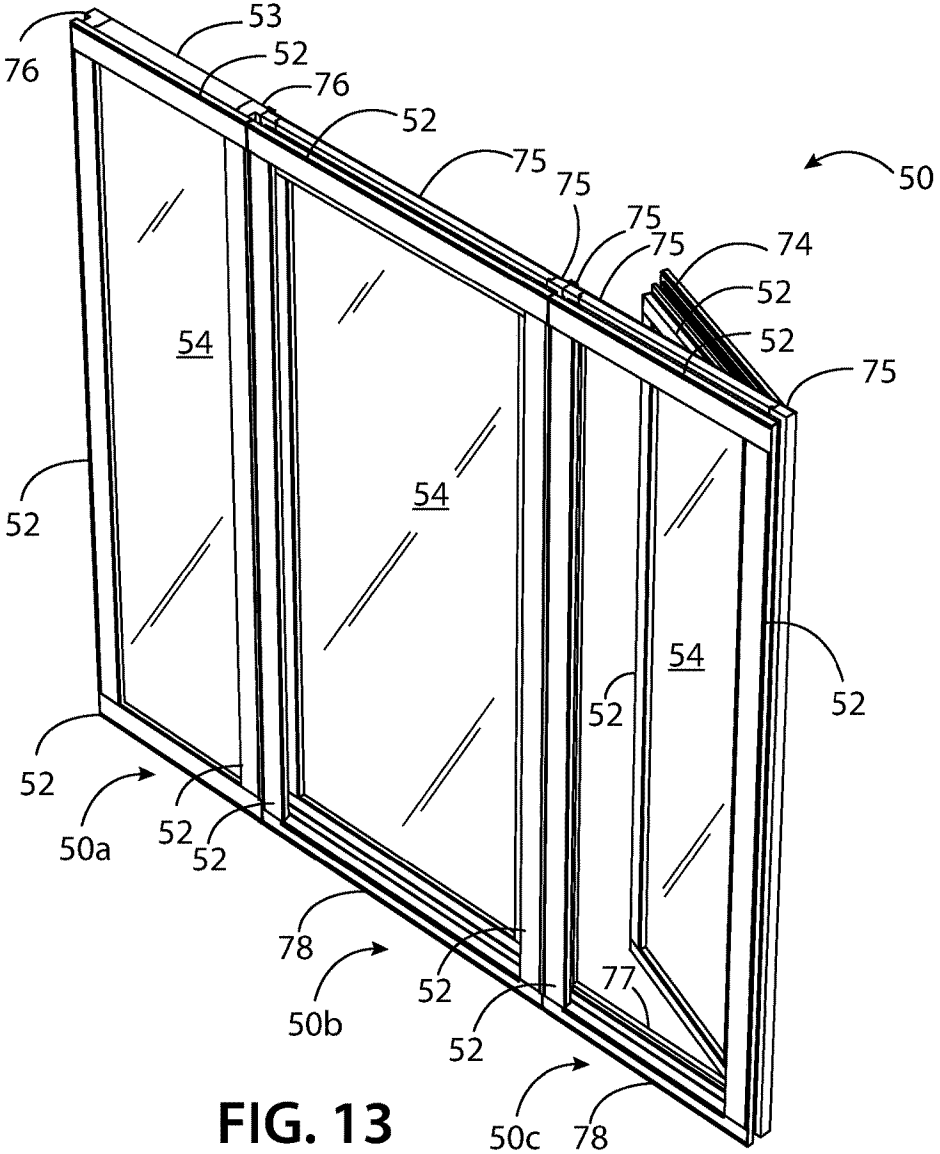
FIG. 13 shows the cladded opening of FIG. 11 with the inswing window portion partially open.

FIGS. 11-13 shows a perspective view of a typical configuration of a cladded fenestration frame opening 50 with glass panels 54 of embodying aspects of the inventive concept. The cladded fenestration frame opening 50 is illustrated with a fixed light opening 50*a*, an inswing door opening 50*b*, and an inswing window opening 50*c* in combination. This combination is shown to more easily illustrate how the same principles can be used to apply and secure the cladding member 52 to various openings and combination of openings. The same principles can easily apply to standalone door, window, and fixed light openings as well as various door, window, and fixed light combinations. Here are some examples; an inswing door in combination with two sidelights (i.e. two narrow fixed lights on either side of a door), a picture window (i.e. fixed light) with adjacent inswing windows on either side of the picture window, two or more adjacent inswing windows, or a wall of fixed light openings. In additions, the principles disclosed can be readily applied to outswing, sliding, and folding doors and windows; single hung, double hung, casement, and awning windows; and curtain walls.

FIG. 12 shows the cladded fenestration frame opening 50 of FIG. 11 with the inswing door opening 50*b* partially open. FIG. 13 shows the cladded fenestration frame opening 50 of FIG. 11 with the inswing window opening 50*c* partially open. Together, FIGS. 12 and 13 illustrate the cladding member 52 covering the outside facing surfaces of frame members 53, 76 of the fixed light opening 50*a*, the cladding member 52 on the outside vertical surfaces and headers of door/window frame members 75 and sash member 74 of the inswing door opening 50*b* and the inswing window opening 50*c*, and the cladding member 78 covering the sill frame members 77 of the inswing door opening 50*b* and the inswing window opening 50*c*.

Figure 14:
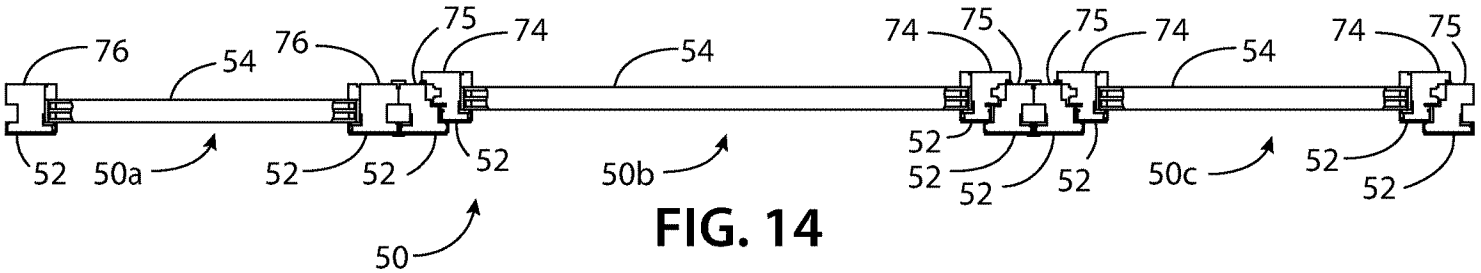
FIG. 14 shows a top plan view of FIG. 11 with the top of the frame removed for clarity.
Figure 15:
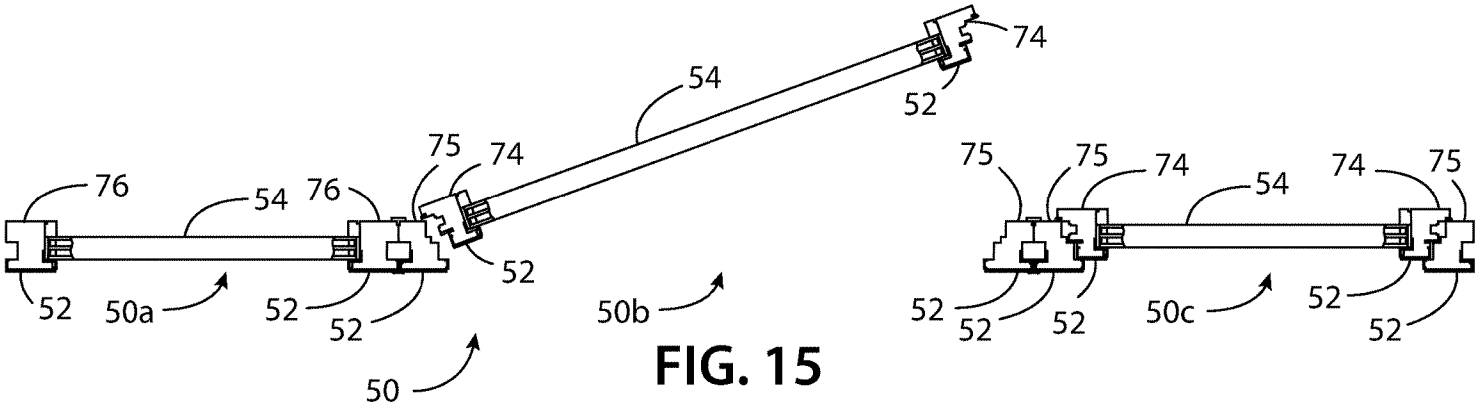
FIG. 15 shows a top plan view of FIG. 12 with the top of the frame removed for clarity.
Figure 16:
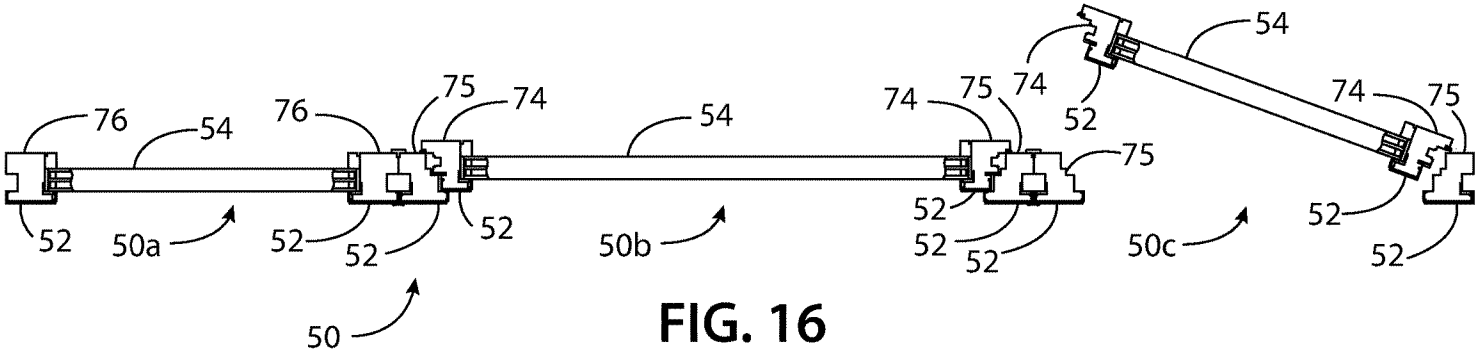
FIG. 16 shows a top plan view of FIG. 13 with the top of the frame removed for clarity.

FIG. 14, FIG. 15, and FIG. 16 show top plan views of FIG. 11, FIG. 12, and FIG. 13 respectively with the headers removed for clarity and viewing of the glass panels 54, the sash members 74 (verticals), and the door/window frame members 75 (door and window side jambs), the frame members 76 (fixed light side jambs) along the top of the fixed light opening 50*a*, the inswing door opening 50*b*, and the inswing window opening 50*c*. FIG. 14 shows a top plan view of the inswing door opening 50*b* and the inswing window opening 50*c* in the closed position. FIG. 15 shows a top plan view of the inswing door opening 50*b* in the open position. FIG. 16 shows a top plan view of the inswing window opening 50*c* in the open position. Together, FIGS. 14-16 illustrate a top view of the cladding member 52 surfaces of the frame members 76 (side jambs) of the fixed light opening 50*a*, as well as the cladding member 52 surfaces of the sash members 74 (vertical sashes) and door/window frame members 75 (side jambs) of both the inswing door opening 50*b* and the inswing window opening 50*c*.

Figure 17:
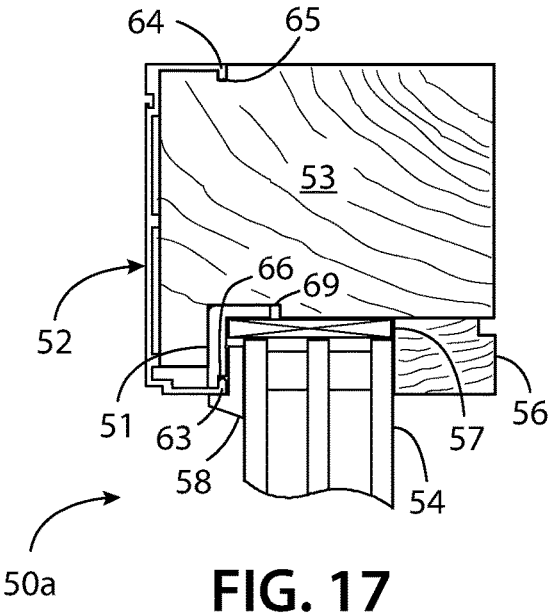
FIG. 17 shows a sectional view of the left-top frame of FIG. 11 taken along section lines 17-17.
Figure 18:
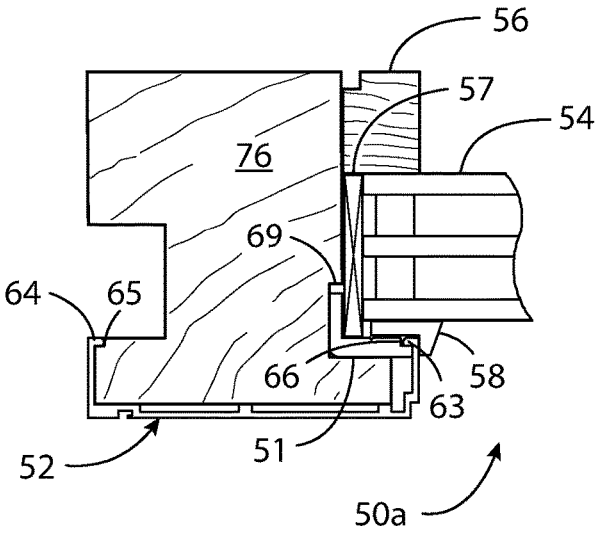
FIG. 18 shows a sectional view of the far-left vertical frame of FIG. 11 taken along section lines 18-18.
Figure 19:
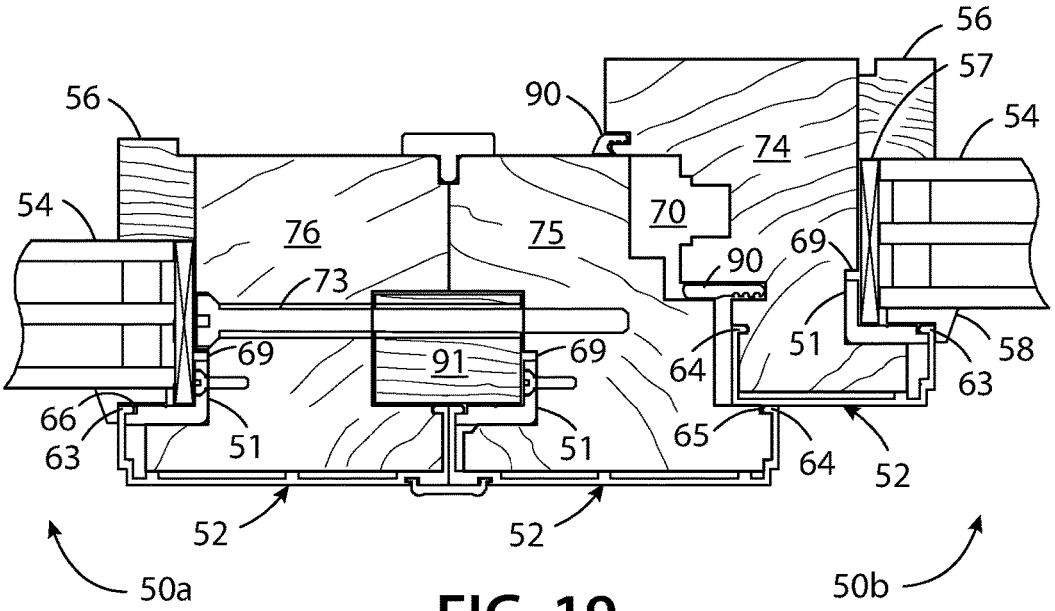
FIG. 19 shows a sectional view of the mid-left vertical frame and sash of FIG. 11 taken along section lines 19-19.
Figure 20:
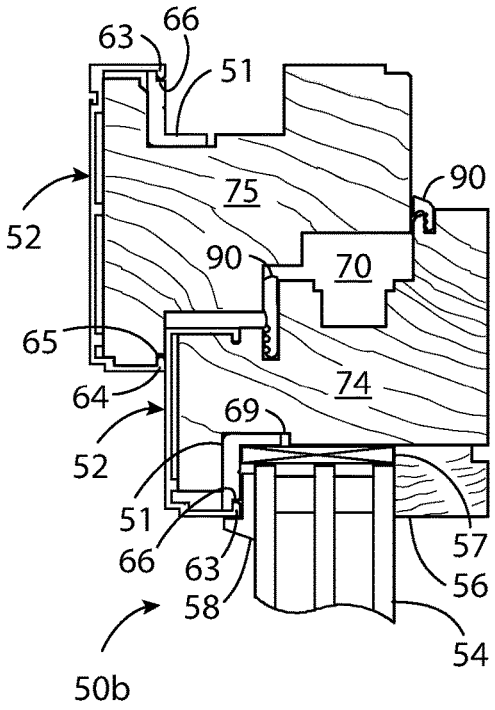
FIG. 20 shows a sectional view of the mid-top frame and sash of FIG. 11 taken along section lines 20-20.
Figure 21:
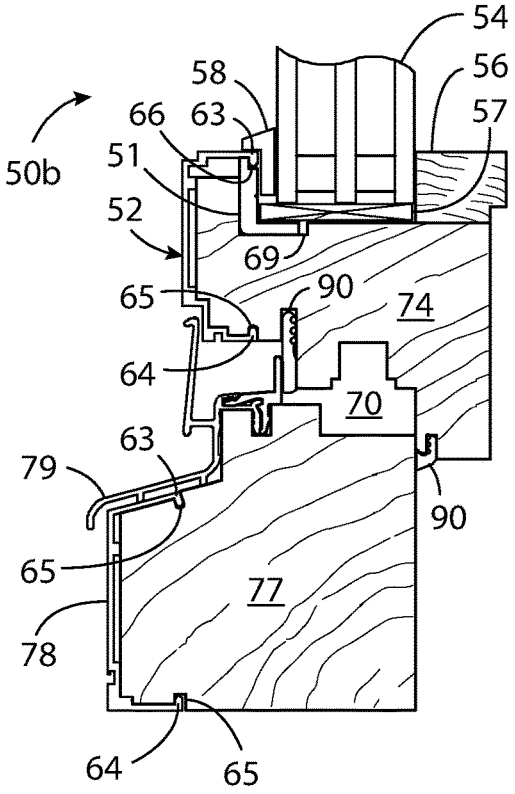
FIG. 21 shows a sectional view of the mid-bottom frame and sash of FIG. 11 taken along section lines 21-21.
Figure 22:
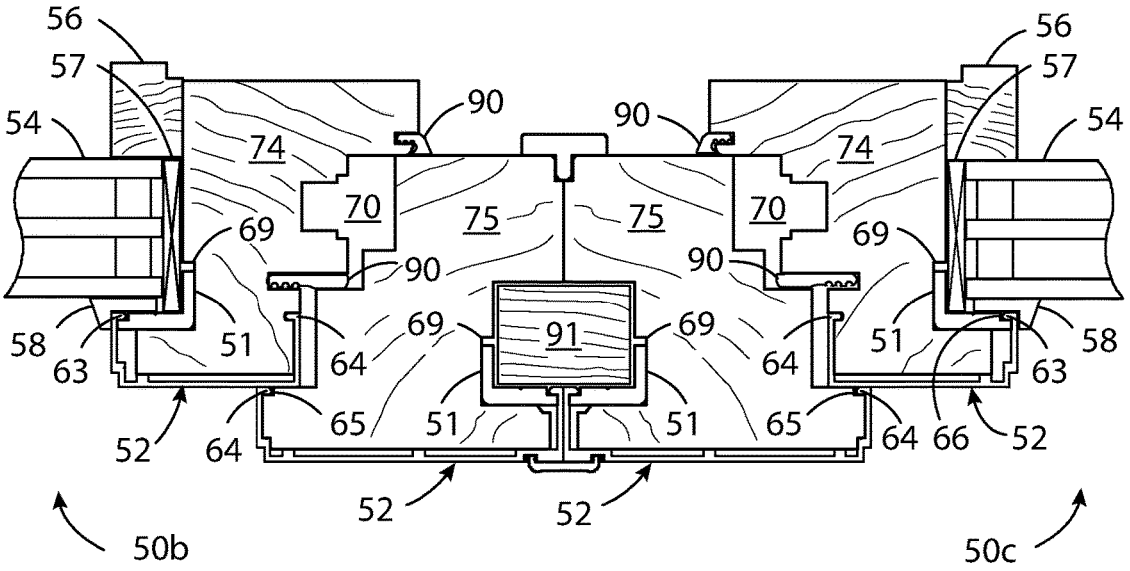
FIG. 22 shows a sectional view of the mid-right vertical frame and sash of FIG. 11 taken along section lines 22-22.
Figure 23:
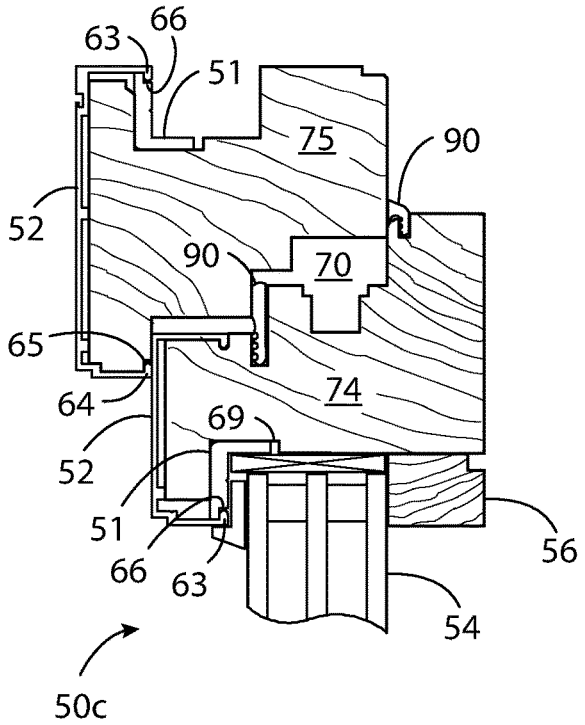
FIG. 23 shows a sectional view of the right-top frame and sash of FIG. 11 taken along section lines 23-23.
Figure 24:
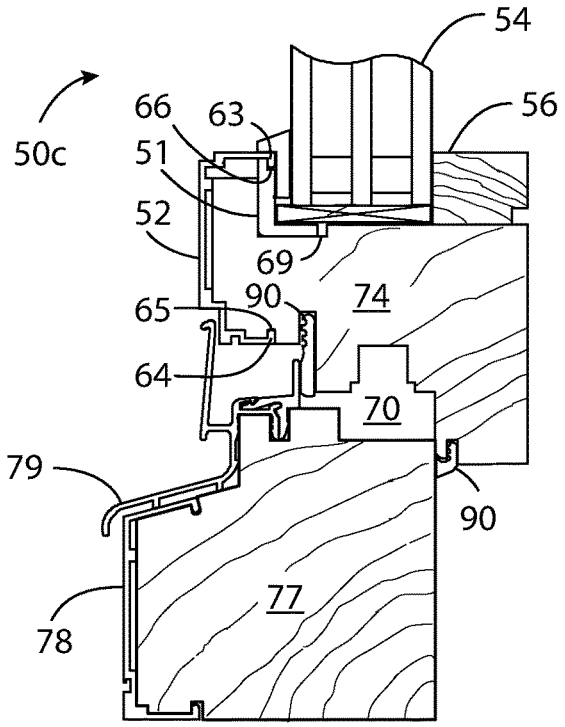
FIG. 24 shows a sectional view of the right-bottom frame and sash of FIG. 11 taken along section lines 24-24.
Figure 25:
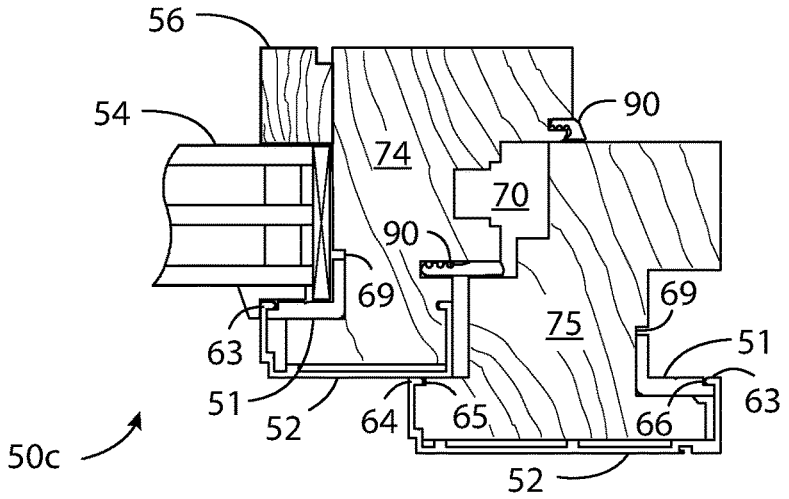
FIG. 25 shows a sectional view of the far right vertical frame and sash of FIG. 11 taken along section lines 25-25.

FIGS. 17-25 illustrate sectional views of various portions of FIG. 11. FIG. 17 shows a sectional view of frame member 53 in the header of fixed light opening 50*a* taken along section lines 17-17. FIG. 18 shows a sectional view of the frame member 76 positioned on the vertical left of the fixed light opening 50*a* taken along section lines 18-18. FIG. 19 shows a frame member 76 positioned on the vertical right of the fixed light opening 50*a* as well as the door/window frame member 75 and sash member 74 positioned on the vertical left of the inswing door opening 50*b* taken along section lines 19-19. FIG. 20 shows a sectional view of the door/window frame member 75 and the sash member 74 in the header of the inswing door opening 50*b* taken along section lines 20-20. FIG. 21 shows a sectional view of the sash member 74 and sill frame member 77 of the inswing door opening 50*b* taken along section lines 21-21. FIG. 22 shows a sectional view of the sash member 74 and the door/window frame member 75 positioned on the vertical right of the inswing door opening 50*b* in combination with the door/window frame member 75 and the sash member 74 of the inswing window opening 50*c* taken along section lines 22-22. FIG. 23 shows a sectional view of the door/window frame member 75 and sash member 74 positioned at the header of the inswing window opening 50*c* and taken along section lines 23-23. FIG. 24 shows a sectional view of the sash member 74 and sill frame member 77 of the inswing window opening 50*c* taken along section lines 24-24. FIG. 25 shows a sectional view of the sash member 74 and door/window frame members 75 of positioned in the far right vertical of the inswing window opening 50*c* and taken along section lines 25-25. For clarity, the sectional shading on the L-shaped bracket 51 and the cladding members 52 have been omitted.

The fixed light opening 50*a*, an inswing door opening 50*b*, and inswing window opening 50*c* of FIGS. 17-25 all share in common aspects of the inventive concept that include the L-shaped bracket 51, grooved end 66 in the L-shaped bracket 51, indentation 69, first end 63 of a cladding member 52, second end 64 of the cladding member 52, and groove 65, as previously described. In FIGS. 19, 20, 22, 23, and 25, a door/window frame member 75 is combined with each of these elements and can be assembled as described for FIG. 10. The frame members 53, 76 of the fixed light opening 50*a* in FIGS. 17-18, and the sash members 74 of both the inswing door opening 50*b* and the inswing window opening 50*c* of FIGS. 19-25 all have an L-shaped bracket 51, a grooved end 66 of the L-shaped bracket 51, a indentation 69, a first end 63 of the cladding member 52, a second end 64 of the cladding member 52, a groove 65, a glass panel 54, a stop block 57, a glazing gasket 58, and glazing stops 56 in the same combination as previously described and can be assembled in the same manner as described in FIG. 7.

Unlike many Euro-style cladding systems, the cladding member 52 does not require gaskets. Instead weather seal gaskets 90 are positioned within the sash members 74 and the door/window frame members 75 as illustrated in FIGS. 19, 20, 22, 23, and 25. The weather seal gaskets 90 between the sash members 74 and the door/window frame members 75 creates a thermal seal in combination with the air pockets 70 created in an interior space between the door/window frame members 75 and the sash members 74.

In FIGS. 19 and 22 the door/window frame members 75 are secured by a combination of threaded fastener 73 (FIG. 19) that extends into both door/window frame members 75 and through a support member 91. The support member 91 is depicted as a wood strip. Support member 91 is optional, but adds additional structural support to the assembly. The support member 91 and threaded fastener 73 are generally assembled with the door/window frame members 75 after securing the cladding members 52 to the door/window frame members 75. The voids between support member 91 and door/window frame members 75 can be filed with silicon sealant.

FIGS. 21 and 24 show a sill that includes a sill frame member 77, cladding member 78, and a weather bar 79. The weather seal gaskets 90 between the sash member 74 and sill frame member 77 create an air pocket 70. This air pocket 70 improves thermal performance.

FIG. 26A-26F shows a sequence of steps for assembling the cladding member 78 to the sill frame member 77 of FIGS. 21 and 24. While the sill frame member 77 of FIGS. 21, 24 and FIGS. 26A-D do not use the combination of L-shaped bracket 51 and cladding member 52 discussed for FIGS. 2-25, its assembly is described here for completeness.

Figure 26A:
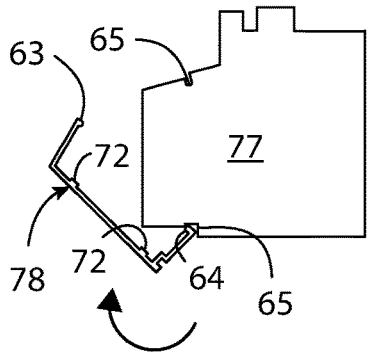
FIG. 26A-26D shows a sequence of steps for assembling the cladding member to a bottom frame such the bottom frame (sill) of FIG. 24.

Referring to FIGS. 21, 24, and 26A, the cladding member 78 is approximately C-shaped with a first end 63 extending downward toward a groove 65 in the top of the sill frame member 77. The cladding member 78 includes a second end 64 extending upward toward a groove 65 in the bottom of the sill frame member 77. Referring to FIG. 26A, the cladding member 78 includes ribs 72 that create air pockets 70 between the cladding member 52 and the sill frame member 77. This is similar to the ribbed structure described for FIGS. 2-3. In FIG. 26A, the second end 64 is aligned and placed within the groove 65 of at the bottom of sill frame member 77 and the cladding member 78 is pivoted about the second end 64 with the first end 63 being rotated toward the groove 65 in the top of the sill frame member 77.

Figure 26B:
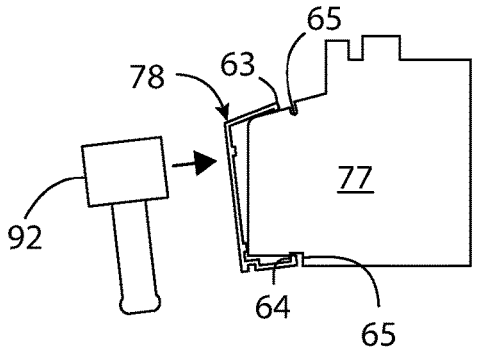

In FIG. 26B, the top of the cladding member 78 is rotated along the top of sill frame member 77 until tension between the cladding member 78 and frame member prevents further rotation. The first end 63 is snapped into the groove 65 by an external force being applied to the body of the cladding member 78, for example, a rubber mallet 92. When the first end 63 is snapped into the groove 65 at the top of the sill frame member 77, the cladding member 78 is now securely held onto the sill frame member 77 by the force being exerted between the first end 63 in combination with the groove 65 on the top surface of the sill frame member 77 and the second end 64 in combination with the groove 65 in the bottom surface of the sill frame member 77.

Figure 26C:
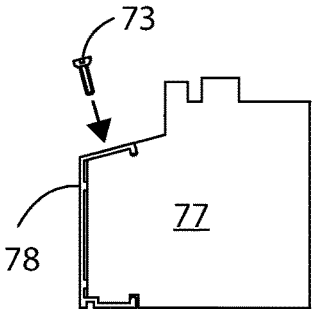
Figure 26D:
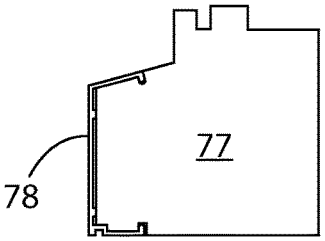

In FIG. 26C a threaded fastener 73 secures the cladding member 78 to the top surface of the sill frame member 77. The threaded fastener 73 can engage the sill frame member 77 through an aperture (not shown) in the cladding member 52. The head of the threaded fastener 73 is typically countersunk as to not interfere with the opening and closing of sash member 74 of FIGS. 12-13. FIG. 26D shows the assembled view of the cladding member 78 and the sill frame member 77.

Figure 27A:
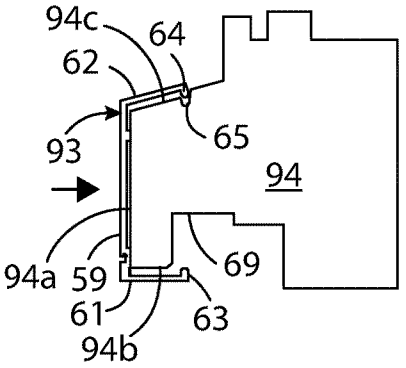
FIG. 27A-27E shows a sequence of steps, similar to FIGS. 9A-E and flow chart of FIG. 10, for assembling a cladding member to a bottom frame (sill).
Figure 27B:
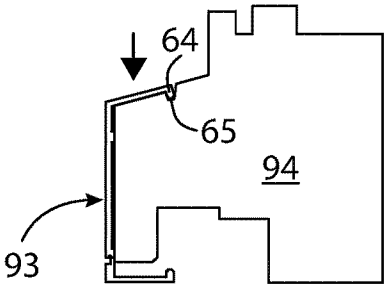
Figure 27C:
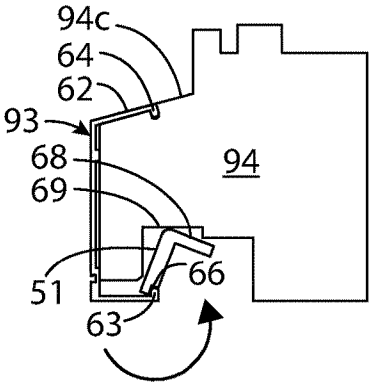
Figure 27D:
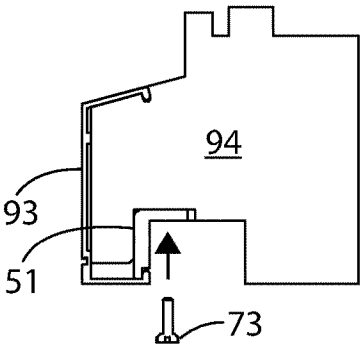
Figure 27E:
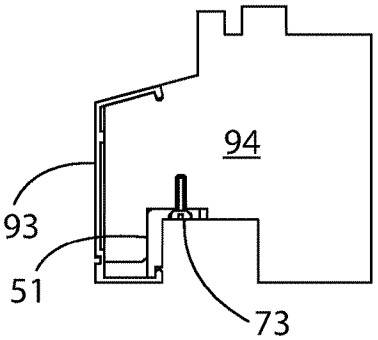

As an alternative to FIGS. 26A-D, FIGS. 27A-E shows a sequence of steps for assembling a cladding member 93 to a sill frame member 94 that follows the assembly steps in the flow chart of FIG. 10. As shown in FIGS. 27C-E, the cladding member 93 is held to the sill frame member 94 by tension created by the combination of the L-shaped bracket 51, sill frame member 94, and the cladding member 93.

Referring to step 81 of FIG. 10 and the assembly illustrated in FIG. 27A, the main body 59 of the cladding member 93 is positioned over the outward-facing surface 94*a* of the sill frame member 94 and the second end 64 of the second arm 62 is positioned over the groove 65 of the second side surface 94*c*. The first end 63 of the first arm 61 is positioned over the indentation 69 in the first side surface 94*b*. The cladding member 93 is substantially C-shaped with the second arm 62 illustrated as extending away from the main body 59 at an obtuse angle to follow the contour of the sill frame member 94.

In step 82 of FIG. 10 and as illustrated in FIG. 27B, the second end 64 of the cladding member 93 is inserted into the groove 65. The second end 64 can extend the entire length of the second side 62 of the sill frame member 94. The groove 65 extends along the second side surface 94*c* a length sufficient to receive the second end 64.

In step 83 of FIG. 10 and as illustrated in FIG. 27C, the grooved end 66 of the L-shaped bracket 51 is engages the first end 63 of the cladding member 93. Once engaged, the L-shaped bracket 51 is rotated in the indentation 69 in the bottom surface (as viewed in FIG. 27C) of the sill frame member 94. The length of the L-shaped bracket 51, position of the first end 63, and the depth of the indentation 69 are such, that when the L-shaped bracket 51 is rotated into the indentation 69, the combination creates a tight friction fit between the indentation 69 and the L-shaped bracket 51. This arrangement creates a clamping force between the first end 63 via the L-shaped bracket 51 and the second end 64 into the sill frame member 94 with the first end 63, the second end 64, surface of the indentation 69, second leg 68 of the L-shaped bracket 51 all aligned and arranged as previously described to increase clamping force by increasing the surface area of clamping. Here, the second end 64 extends perpendicularly away from second arm 62. By this arrangement, the second end 64 perpendicularly engages the second side surface 94*c*. Similarly, the second leg 68 of the L-shaped bracket 51 planarly engages the indentation 69. This creates a perpendicular clamping force between the first end 63 and indentation 69. The first end 63 and the second end 64 are shown aligned over each other.

In step 84 of FIG. 10, and as illustrated in FIG. 27D, a threaded fastener 73 secures the L-shaped bracket 51 and the cladding member 93 to the sill frame member 94 through an aperture in the L-shaped bracket 51 (aperture not illustrated). FIG. 9E illustrates the final assembly the cladding member 93, L-shaped bracket 51, the threaded fastener 73, and the sill frame member 94 in combination.

This disclosure described examples that embody aspects of the inventive concept in various combinations. The purpose of this is to help the reader to understand how common aspects of the inventive concept can be applied to a wide variation of cladded doors, windows, and fixed light openings. For example, common aspects of the inventive concept can readily be applied to inswing, outswing, and sliding doors and windows; fixed light, awing, single hung, and double hung windows; curtain walls; and folding doors based on the principles discussed in this disclosure. Aspects of the inventive concept are illustrated for wood frame members and sashes in various configurations to demonstrate how the same principles can be applied to fenestration frame members in general, for example, fiberglass, composite, or PVC frames members and sashes. While these examples and variations are helpful to those skilled in the art in understanding the claimed invention, the scope of the claimed invention is defined solely by the following claims and their equivalents.

What is claimed is:

1. A cladded assembly for fenestrations, comprising:

a fenestration frame including a first side surface with an indentation, a second side surface opposing the first side surface, the second side surface including a groove longitudinally aligned with the indentation;

a rigid L-shaped bracket including a first leg with a grooved end and a second leg perpendicular to the first leg, the second leg planarly engaging the indentation;

a C-shaped cladding member including a first end engaging the groove and a second end engaging the grooved end; and the first end and the grooved end pivotally engage the second leg and the indentation under tension.

2. The cladded assembly of claim 1, wherein the first end and the second end are longitudinally aligned along a same plane.

3. The cladded assembly of claim 1, further including an enclosed air pocket bound by the C-shaped cladding member and the fenestration frame.

4. The cladded assembly of claim 1, further including:

an outward projected portion projecting away from the first side surface and forming a projection side surface projecting perpendicularly from the indentation; and the first leg engaging the projection side surface.

5. A cladded assembly for fenestrations, comprising:

a fenestration frame including a first side surface with an indentation, a second side surface opposing the first side surface and including a groove longitudinally aligned with the indentation, and an outward-facing surface adjacent to the first side and the second side;

a rigid L-shaped bracket including a first leg with a grooved end and a second leg perpendicular to the first leg, the second leg planarly engaging the indentation;

a cladding member including a main body covering the outward-facing surface, a first end engaging the groove, and a second end engaging the grooved end, the first end and the second end parallel to the main body; and the first end and the grooved end pivotally engage the second leg and the indentation under tension.

6. The cladded assembly of claim 5, wherein the first end and the second end are longitudinally aligned along a same plane.

7. The cladded assembly of claim 5, further including an enclosed air pocket bound by the cladding member and the fenestration frame.

8. The cladded assembly of claim 5, further including:

an outward projected portion projecting away from the first side surface and forming a projection side surface projecting perpendicularly from the indentation; and the first leg engaging the projection side surface.

9. The cladded assembly of claim 5, further including:

a first arm projecting directly and inwardly away from a main body first end and along the first side surface;

a second arm projecting inwardly away from a main body second end and along the second side surface; and the first end projecting away from the first arm and the second end projecting away from the second arm.

10. A cladded assembly for fenestrations, comprising:

a fenestration frame including a first side surface with an indentation, a second side surface opposing the first side surface, the second side surface including a groove longitudinally aligned with the indentation;

a rigid L-shaped bracket including a first leg with a grooved end and a second leg perpendicular to the first leg, the second leg planarly engaging the indentation;

a C-shaped cladding member including a first end engaging the groove and a second end engaging the grooved end;

an enclosed air pocket bound by the C-shaped cladding member and the fenestration frame; and the first end, the second end, and L-shaped bracket positioned and aligned to create a clamping force from the C-shaped cladding member between the groove and the indentation.

11. The cladded assembly of claim 10, wherein the first end and the second end are longitudinally aligned along a same plane.

12. The cladded assembly of claim 10, wherein:

the fenestration frame including an outward-facing surface adjacent to the first side and the second side; and the C-shaped cladding member including a main body covering the outward-facing surface, the first end and the second end parallel to the main body.

13. The cladded assembly of claim 10, wherein:

the first end and the grooved end pivotally engage the second leg and the indentation under tension.

14. The cladded assembly of claim 10, further including:

an outward projected portion projecting away from the first side surface and forming a projection side surface projecting perpendicularly from the indentation; and the first leg engaging the projection side surface.

15. A cladded assembly for fenestrations, comprising:

a fenestration frame including a first side surface with an indentation, a second side surface opposing the first side surface, the second side surface including a groove longitudinally aligned with the indentation;

a rigid L-shaped bracket including a first leg with a grooved end and a second leg perpendicular to the first leg, the second leg planarly engaging the indentation;

a C-shaped cladding member including a first end engaging the groove and a second end engaging the grooved end;

the first end and the grooved end pivotally engage the second leg and the indentation under tension; and the first end, the second end, and L-shaped bracket positioned and aligned to create a clamping force from the C-shaped cladding member between the groove and the indentation.

16. The cladded assembly of claim 15, wherein the first end and the second end are longitudinally aligned along a same plane.

17. The cladded assembly of claim 15, wherein:

the fenestration frame including an outward-facing surface adjacent to the first side and the second side; and the C-shaped cladding member including a main body covering the outward-facing surface, the first end and the second end parallel to the main body.

18. The cladded assembly of claim 15, further including an enclosed air pocket bound by the C-shaped cladding member and the fenestration frame.

19. The cladded assembly of claim 15, wherein:

an outward projected portion projecting away from the first side surface and forming a projection side surface projecting perpendicularly from the indentation; and the first leg engaging the projection side surface.

* * * * *